US006733230B2

(12) United States Patent
Miura et al.

(10) Patent No.: US 6,733,230 B2
(45) Date of Patent: May 11, 2004

(54) LOW NOISE IMPELLER PUMPS

(75) Inventors: Satoshi Miura, Aichi-ken (JP); Masaki Ikeya, Aichi-ken (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/384,566

(22) Filed: Mar. 11, 2003

(65) Prior Publication Data

US 2003/0175111 A1 Sep. 18, 2003

(30) Foreign Application Priority Data

Mar. 13, 2002 (JP) ..... 2002-069149
Jun. 19, 2002 (JP) ..... 2002-178991

(51) Int. Cl.[7] ..... F04D 5/00

(52) U.S. Cl. ..... 415/55.1; 415/55.2; 415/55.6; 415/98; 415/100; 415/101

(58) Field of Search ..... 415/55.1, 55.2, 415/55.6, 98, 100, 101

(56) References Cited

U.S. PATENT DOCUMENTS 4,586,877 A * 5/1986 Watanabe et al. ..... 417/365
6,162,012 A * 12/2000 Tuckey et al. ..... 415/55.1

* cited by examiner

*Primary Examiner*—Ninh H. Nguyen
(74) *Attorney, Agent, or Firm*—Dennison, Schultz, Dougherty & MacDonald

(57) ABSTRACT

An impeller pump has a pump casing (6) that defines a pump chamber. The pump chamber includes a first chamber (21) and a second chamber (22). An impeller (10) is rotatably disposed within the pump chamber. The impeller has a first groove group and a second groove group on opposite surfaces. The first groove group and the second groove group oppose to the first chamber and the second chamber, respectively, so that a fluid is draw into and discharged from the first and second chambers as the impeller rotates. The flows of the fluid discharged from the first and second chambers are converged at a converging channel (26). Pulsations of the fluid discharged from the fist and second chambers are canceled each other when the flows converge at the converging channel.

37 Claims, 20 Drawing Sheets

LOW NOISE IMPELLER PUMPS

This application claims priorities to Japanese patent application serial numbers 2002-069149 and 2002-178991, the contents of which are incorporated herein by reference.

BACKGROUND OF THE INVENTION

1. Field of the Invention

The present invention relates to impeller pumps of a type known as Westco pumps, generative or friction pumps, cascade pumps and circumferential-flow pumps that have rotary impellers. In particular, the present invention relates to impeller pumps that are suitably used as fuel pumps for vehicles, e.g. automobiles.

2. Description of the Related Art

Japanese Laid-Open Patent Publication No. 3-18688 teaches a know Westco pump that includes a pump casing and an impeller rotatably disposed within the pump casing. A plurality of grooves are formed in the outer periphery on each side of the impeller and are arranged in the circumferential direction. The pump casing defines a pump chamber that opposes to the grooves. An inlet port and an outlet port are defined in the pump casing and communicate with the pump channel.

In general, when low noise pumps are desired, Westco pumps are chosen due to their low noise properties in comparison with displacement-type pumps, e.g., gear pumps, vane pumps and trochoid pumps. When a pump is operated, a fluid with pulsation in pressure is discharged from the pump. As for Westco pumps, pulsation of a fluid discharged from Westco pumps may appear as a periodical-variation in flow rate (an alternative component or a variation component) that is superposed on a uniform flow rate (a linear component or a constant component). Therefore, Westco pumps may produce relatively low noises in comparison with displacement-type pumps as described above.

However, known Westco pumps still generate noises due to periodical variation in flow rate that may be caused by the nature of impellers that have vane grooves or vanes spaced from each other in the circumferential direction.

In addition, due to recent demands for low-noise automobiles, there has been a strong demand for low-noise impeller pumps that are used as fuel pumps for automobiles.

SUMMARY OF THE INVENTION

It is accordingly an object of the present invention to teach improved techniques for reducing or minimizing noises from impeller pumps.

According to one aspect of the present teachings, impeller pumps are taught that may have at least one pump chamber each including a first chamber and a second chamber. An impeller may be rotatably disposed within the pump chamber. The impeller may have a first groove group and a second groove group on opposite surfaces. The first groove group and the second groove group may oppose to the first chamber and the second chamber, respectively, so that a fluid is draw into and discharged from the first and second chambers as the impeller rotates. The flows of the fluid discharged from the pump chambers may have pulsations that are canceled each other when the flows of the fluid are converged at the converging channel.

Therefore, noises that may be produced due to pulsations of the fluid may be reduced or minimized.

According to another aspect of the present teachings, the pulsations of the fluid may be cancelled by determining the relative positions of the first groove group and the second groove group in the circumferential direction and/or the relative positions of outlets ports of the first and second chambers.

According to another aspect of the present teachings, the outlet ports of the first and second chambers may be positioned at the same position in the circumferential direction. On the other hand, the first groove group and the second groove group may be offset from each other by a distance that may correspond to a pitch of the grooves in the circumferential direction divided by the number of the groove groups. For example, if the pump includes a single pump chamber, the first groove group and the second groove group may be offset from each other by a distance that may correspond to half the pitch of the grooves. As a result, the phases of pulsations of the fluid from the first and second chambers may be shifted from each other by a cyclic period of the pulsations divided by the number of the groove groups. Therefore, the pulsations may be canceled when the flows of the fluid from the first and second chambers converged at the converging channel.

According to another aspect of the present teachings, the first groove group and the second groove group may be positioned at the same position in the circumferential direction. On the other hand, the outlet ports of the first and second chambers may be offset from each other by a distance that may correspond to a pitch of the grooves in the circumferential direction divided by the number of the groove groups. For example, if the pump includes a single pump chamber, the outlet ports may be offset from each other by a distance that may correspond to half the pitch of the grooves. As a result, the phases of pulsations of the fluid from the first and second chambers may be shifted from each other by a cyclic period of the pulsations divided by the number of the groove groups. Therefore, the pulsations may be canceled when the flows of the fluid from the first and second chambers converged at the converging channel.

According to another aspect of the present teachings, the first groove group and the second groove group may be offset from each other in the circumferential direction. In addition, the outlet ports of the first and second chambers also may be offset from each other. The offset distances may be appropriately determined in response to the number of the groove groups.

According to another aspect of the present teachings, the first chamber and the second chamber communicate with each other, so that the pressure within the first chamber and pressure within the second chamber may be balanced with each other. As a result, the pulsations in the discharged fluid may be further reduced or minimized.

According to another aspect of the present teachings, the fluid is a fuel that is supplied to an automobile engine. Therefore, the pump may be configured as a low noise fuel pump that is advantageously incorporated into an automobile in order to reduce noises.

BRIEF DESCRIPTION OF THE DRAWINGS

Additional objects, features and advantages of the present invention will be readily understood after reading the following detailed description together with the claims and the accompanying drawings, in which:

DETAILED DESCRIPTION OF THE INVENTION

Figure 1:
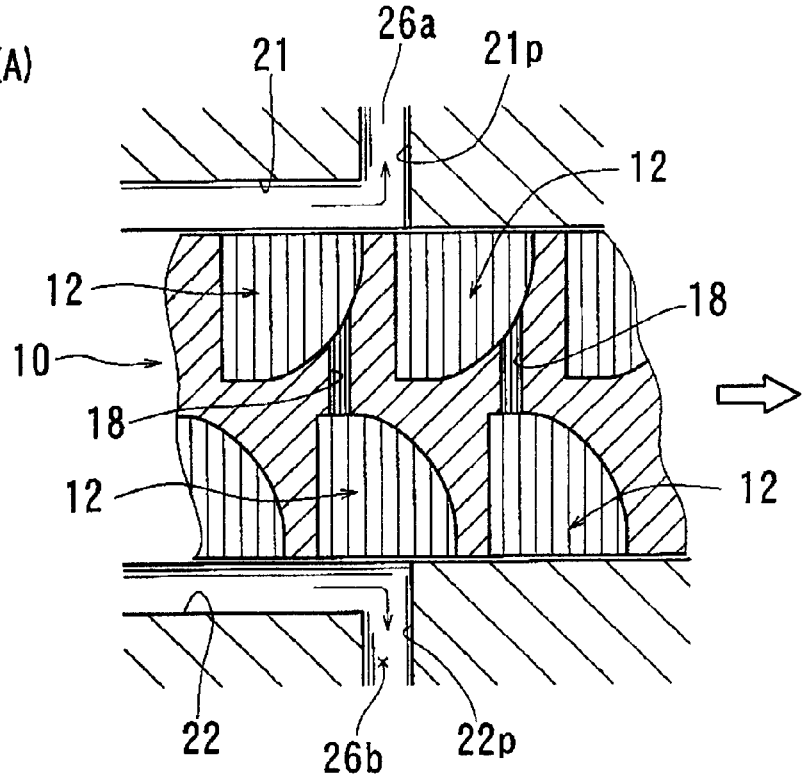
FIG. 1(A) is an enlarged vertical sectional view of a portion including an impeller and a pump casing of a first representative impeller pump.
FIG. 1(B) is a graph schematically showing pulsation of a fuel discharged from a first chamber and pulsation of a fuel discharged from a second chamber of the first representative impeller pump.
Figure 1:
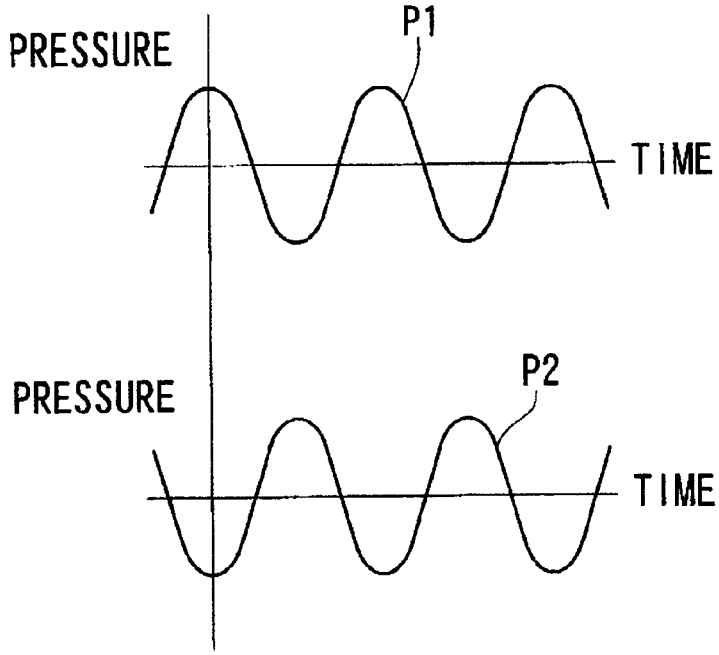
Figure 2:
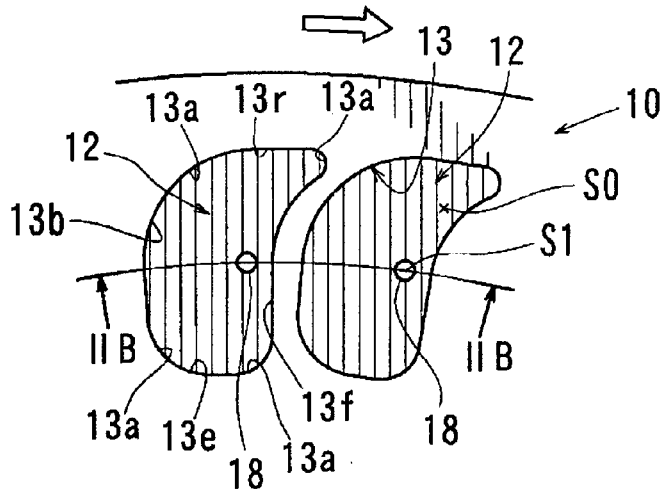
FIG. 2(A) is an enlarged plan view of a region indicated by an arrow IIA in FIG. 2(C) of the impeller.
FIG. 2(B) is a sectional view taken along line IIB—IIB in FIG. 2(A)
FIG. 2(C) is a plan view of the impeller.
Figure 2:
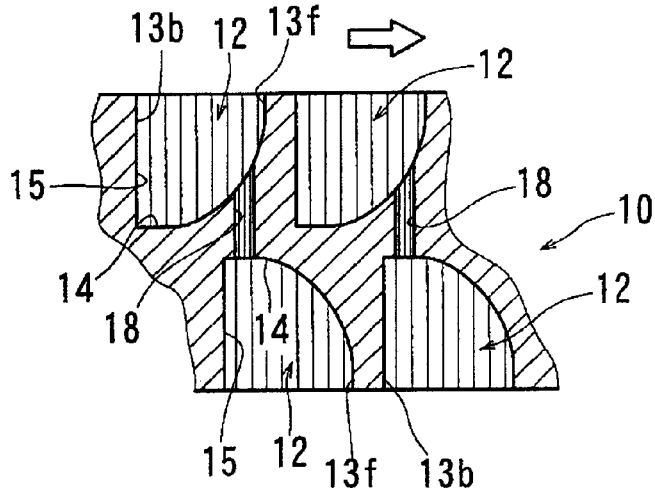
Figure 2:
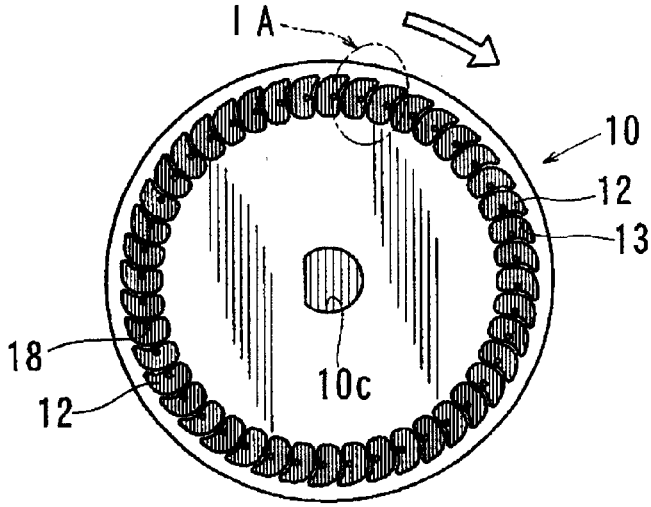
Figure 3:
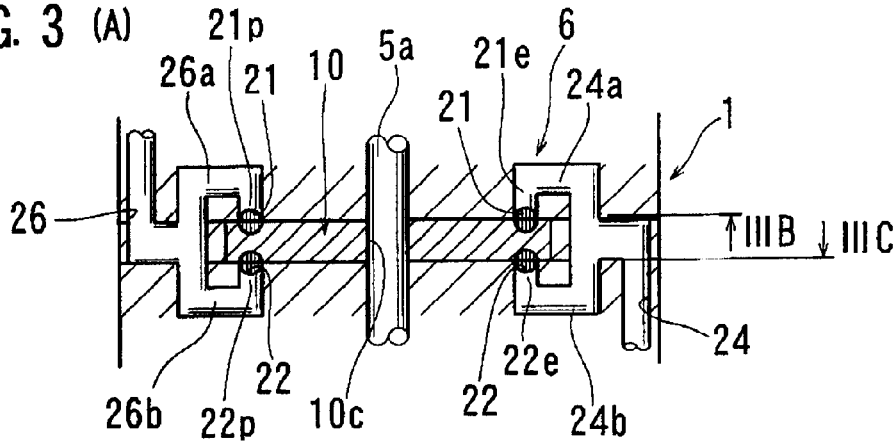
FIG. 3(A) a schematic vertical sectional view of a pump section.
FIG. 3(B) is a sectional view taken along line IIIB—IIIB in FIG. 3(A)
FIG. 3(C) is a sectional view taken along line IIIC—IIIC in FIG. 3(A)
Figure 3:
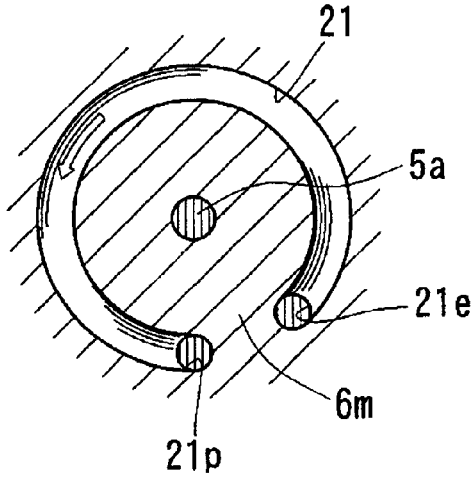
Figure 3:
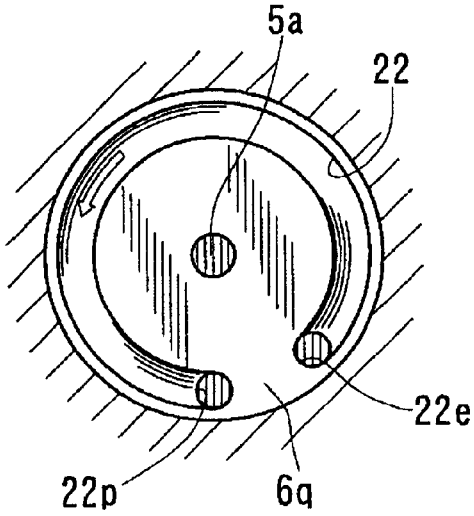

In one embodiment of the present teachings, impeller pumps may include a pump casing and an impeller disposed within the pump casing. The impeller may be rotatably driven about a rotational axis. A first groove group may be disposed on one side of the impeller and a second groove group may be disposed on the other side of the impeller. Each of the first and second groove group may include a plurality of grooves arranged in the circumferential direction of the impeller. As the impeller rotates, the first groove group and the second groove group may generate pulsations in the discharged fluid, which pulsations may have the same cyclic period.

A first chamber may be defined within the pump casing and may have a first inlet port and a first outlet port. The first chamber may oppose to the first groove group of the impeller. A second chamber may be defined within the pump casing and may have a second inlet port and a second outlet port. The second chamber may oppose to the second groove group of the impeller.

A communication hole may be defined within the impeller and may extend between the first chamber and the second chamber.

A converging channel may be defined within the pump casing and may communicate with the first outlet port and the second outlet port, so that the fluid discharged from the first outlet port and the fluid discharged from the second outlet port may converge at the converging channel.

The first groove group and the second groove group may be offset from each other in the circumferential direction and/or the first outlet port of the first chamber and the second outlet port of the second chamber may be offset from each other in the circumferential direction, so that a phase of pulsation of the fluid discharged from the first chamber is shifted relative to a phase of pulsation of the fluid discharged from the second chamber by half the cyclic period of the pulsations.

Because the first chamber and the second chamber may communicate with each other via the communication hole, the pressure of the fluid within the first chamber and the pressure of the fluid within the second chamber may be substantially equal to each other, In addition, because the phase of pulsation of the fluid discharged from the first chamber may be shifted relative to the phase of pulsation of the fluid discharged from the second chamber by half the cyclic period of the pulsation or about 180°, the pulsation of the fluid discharged from the first chamber and the pulsation of the fluid discharged from the second chamber may be canceled when the flows of the fluid are converged at the converging channel. As a result, noises of pumps due to pulsations may be reduced or minimized.

In another embodiment of the present teachings, pumps may include a plurality of pump sections. Each of the pump sections may include an impeller disposed within the pump casing. The first groove group and the second groove group on both sides of each impeller may be offset from each other in the circumferential direction and/or the first outlet port of the first chamber and the second outlet port of the second chamber may be offset from each other in the circumferential direction, so that the phase of pulsation of the fluid discharged from the first chamber may be shifted relative to the phase of pulsation of the fluid discharged from the second chamber by a predetermined period. In addition, the first outlet port of the first chamber of each of the pump sections is offset in the circumferential direction relative to the first outlet port of the first chamber of the adjacent pump section, so that the phases of pulsation of the fluid discharged from the first chambers of two adjacent pump sections are shifted by substantially half the cyclic period.

Therefore, when the phase of the pulsation of the fluid discharged from the fist pump chamber for the impeller of the fist stage is taken as a reference, the phase of the pulsation of the fluid discharge from the first chamber for the impeller of the second stage,—and the phase of the pulsation of the fluid from the first chamber for the impeller of the Nth stage may be in turn offset from each other by half the cyclic period (180°).

Similarly, when the phase of the pulsation of the fluid discharged from the second chamber for the impeller of the fist stage is taken as a reference, the phase of the pulsation of the fluid from the second chamber for the impeller of the second stage,—and the phase of pulsation of the fluid from the second chamber for the impeller of the Nth stage may be in turn offset from each other by half the cyclic period (180°).

In addition, the phase of pulsation of the fluid from the fist pump chamber and the phase of pulsation of the fluid from the second chamber of each stage may be offset by a predetermined period.

Therefore, in each stage, the pulsation of the fluid from the first chamber and the pulsation of the fluid from the second chamber may be canceled each other when the fluid is converged at the converging channel.

In another embodiment of the present teachings, the communication hole may be formed to extend between one of the grooves of the first groove group and the corresponding one of the grooves of the second groove group that oppose to each other in the axial direction, i.e., in the direction parallel to the rotational axis of the impeller.

In another embodiment of the present teachings, the communication hole may communicate with the axially opposing grooves at inner or outer edges of the grooves in the radial direction of the impeller. Otherwise, the communication hole may be defined in a position away from the inner or outer edges of the axially opposing grooves and may communicate with these grooves via additional grooves that are formed in continuity with these grooves.

In another embodiment of the present teachings, the communication hole may be defined in a position that does not interfere with the grooves. Preferably, the communication hole may be defined in a position adjacent to one pair of the axially opposing grooves. For example, the communication hole may be defined in a position adjacent to inner or outer edges of the opposing grooves.

In another embodiment of the present teachings, the first and second chambers may be configured to extend over the communication hole.

In another embodiment of the present teachings, a plural number of communication holes may be defined and may communicate or not communicate with the corresponding pairs of the opposing grooves. Preferably, the number of the pairs of the opposing grooves that communicate with the corresponding communication holes may be larger than the number of the pairs of the opposing grooves that do not communicate with the communication holes. More preferably, all the grooves on one side and on the other side of the impeller may communicate with each other via communication holes.

In another embodiment of the present teachings, the ratio of the cross sectional area of the communication hole to the open area of each groove may be set to be within a range of about 1% to 70% and preferably within a range of about 3% to 18%, so that the pulsation may be further reduced.

Each of the additional features and teachings disclosed above and below may be utilized separately or in conjunction with other features and teachings to provide improved impeller pumps and using such impeller pumps. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A first representative impeller pump will now be described with references to FIGS. 1(A) and 1(B), FIGS. 2(A) to 2(C), FIGS. 3(A) to 3(C), FIG. 4, FIGS. 5(A) to 5(D) and FIGS. 6(A) and 6(B). The first representative impeller pump may be a Westco pump and may be configured as a fuel pump that is mounted on an automobile for delivering a fuel, e.g., gasoline, to an engine, e.g. an internal combustion engine. In particular, the first representative impeller pump may be designed to be disposed within a fuel tank of the automobile.

Figure 4:
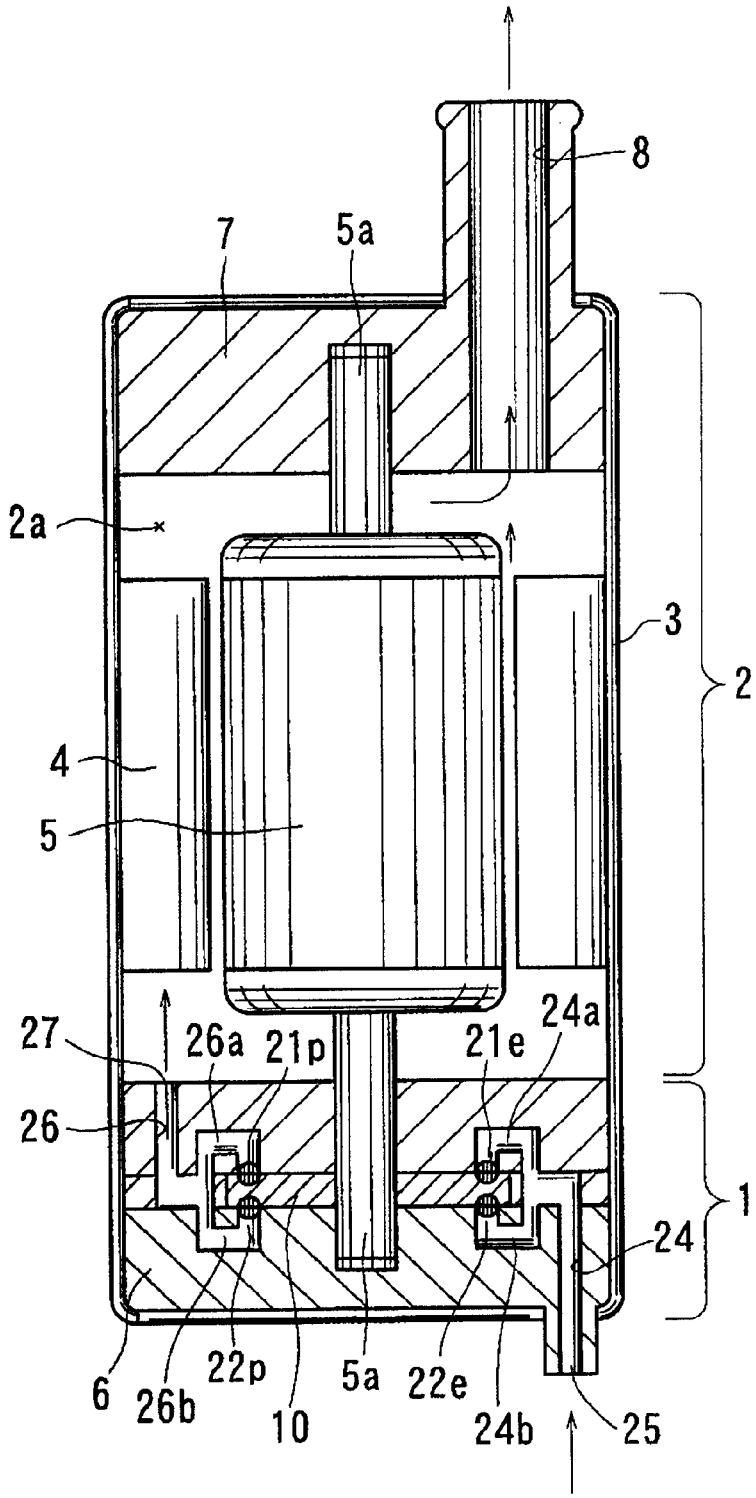
FIG. 4 is a vertical sectional view of the impeller pump.

Referring to FIG. 4, the first representative impeller pump may have a pump section 1 and a motor section 2. The motor section 2 is adapted to rotate an impeller 10 of the pump section 1.

The motor section 2 may be configured as a brush-type DC motor and may have magnets 3 and an armature 5 that are disposed within a substantially cylindrical tubular pump housing 3. The armature 5 may have a shaft 5*a*.

A pump casing 6 may be disposed within a first end portion (lower end portion as viewed in FIG. 4) of the pump housing 3. One end (lower end as viewed in FIG. 4) of the shaft 5*a* of the armature 5 may be rotatably supported by the pump casing 6.

A motor cover 7 may be disposed within a second end portion (upper end portion as viewed in FIG. 4) of the pump housing 3. The other end (upper end as viewed in FIG. 4) of the armature 5 may be rotatably supported by the motor cover 7.

A discharge port 8 may be defined within the motor cover 7, so that an inner space 2*a* within the motor section 2 may communicate with the outside via the discharge port 8. A fuel delivery pipe (not shown) may be connected to the discharge port 8 in order to deliver the fuel to an automobile engine (not shown), e.g., an internal combustion engine.

The motor section 2 may be designed such that the armature 5 can rotate when a power is supplied to a coil (not shown) of the armature 5 via terminals (not shown) that are mounted on the motor cover 7. Because a DC motor having an armature that rotates by the supply of a power is well known in the art, more detailed explanation of the motor section 2 will not be necessary. In addition, the motor section 2 may be replaced with any other known motor or drive mechanism that is different in type from the motor section 2.

The pump section 1 of the representative impeller pump will now be described. Referring to FIG. 3(A), the pump section 1 may have a single impeller 10 that is disposed within the pump casing 6. The pump casing 6 may be constituted by a plurality of casing members that are separated from each other in the upward and downward directions as viewed in FIG. 3(A), i.e., an axial direction of the shaft 5*a* of the armature 5. The casing members may be assembled with each other to define an impeller receiving space.

The impeller 10 may be rotatably disposed within the impeller receiving space. Preferably, the impeller 10 may have a substantially disk-like configuration and may have a substantially uniform thickness. A substantially D-shaped axial hole 10*c* may be formed in the center of the impeller 10 (see FIG. 2(C)). The shaft 5*a* of the armature 5 of the motor section 2 may engage the axial hole 10*c* in the rotational direction, so that the impeller 10 rotates about the axis of the shaft 5*a* as the armature 5 rotates.

Referring to FIGS. 2(A) to 2(C), a group of grooves 12 may be formed in the peripheral portion on each of upper and lower surfaces of the impeller 10. The grooves 11 on each of upper and lower surfaces of the impeller 10 may be arranged at regular intervals in the circumferential direction. In other words, grooves 11 may be spaced from each other by a predetermined pitch, so that a vane or fin may be defined between two adjacent grooves 11. However, as shown in FIG. 2(B), the group of the grooves 11 on one side, i.e., on the upper surface, of the impeller 10 may be offset by a distance that may correspond to half or substantially half the pitch of the grooves 11.

As shown in FIG. 2(A), each of the grooves 12 may have an opening 13 that opens on one side of the impeller 10 in the axial direction. The opening 13 may be defined by a front edge 13*f* on the front side in the rotational direction of the impeller 10, a rear edge, 13*b* on the rear side in the rotational direction, an inner edge 13*e* on the inner side in the radial direction of the impeller 10, and an outer edge 13*r* on the outer side in the radial direction. The edges 13*f*, 13*e*, 13*b* and 13*r* may be joined to each other via curved edges 13*a*.

Each of the front edge 13*f* and the rear edge 13*b* may have an inner part (on the side of the inner edge 13*e*) that extends substantially in the radial direction. In addition, each of the front edge 13*f* and the rear edge 13*b* may have an outer part (on the side of the outer edge 132) that is curved toward the front side in the rotational direction. Further, each of the grooves 12 may have a bottom wall 14 and a side wall 15. As shown in FIG. 2(B), a part of the side wall 15 that defines the rear edge 13*b* may extend substantially vertically relative to the upper and lower surfaces of the impeller 10. In addition, a part of the side wall 15 that defines the front edge 13*f* may be curved in cross section. Thus, the depth of the groove 12 may become maximum at the rear edge 13*b* or at a position adjacent to the rear edge 13*b*.

Referring to FIG. 2(A), each of the grooves 12 on the upper side of the impeller 10 may communicate with one of the grooves 12 on the lower side of the impeller via a communication hole 18. In other words, each pair of the grooves 12 that oppose to each other in the axial direction of the impeller 10 may communicate with each other via the communication hole 18. Preferably, the communication hole 18 may have a cross sectional area S1 (a cross sectional area within a plane perpendicular to the rotational axis of the impeller 10) that is about 1% to about 70% of an open area S0 of the opening 13 (the area of the opening 13 within a plane perpendicular to the rotational axis of the impeller 10). As will be hereinafter described, the cross sectional area S1 may preferably be determined within a range between about 3% and about 18% of the open area S0.

Referring to FIGS. 3(A) and 3(B), a substantially arc-shaped first channel groove 21 may be formed in an upper wall of the impeller receiving space of the pump casing 6 and may oppose to the grooves 12 that are formed on the upper side of the impeller 10 as viewed in FIG. 3(A).

The first channel groove 21 may cooperate with upper side grooves 12 of the impeller 10 to define a first chamber. Therefore, the first channel groove 21 will be hereinafter also called "first chamber 21."

The pump casing 6 defines a first inlet port 21*e* disposed at one end of the first chamber 21 in the direction opposite to the rotational direction of the impeller 10. A first outlet port 21*p* may be defined at the other end of the first chamber 21 in the rotational direction of the impeller 10.

The first inlet port 21*e* and the first outlet port 21*p* may be separated from each other by a partition wall 6*m* of the pump casing 6.

Similarly, referring to FIGS. 3(A) and 3(C), a substantially arc-shaped second channel groove 22 may be formed in a lower wall of the impeller receiving space of the pump casing 6 and may oppose to the grooves 12 that are formed on the lower side of the impeller 10 as viewed in FIG. 3(A).

The second channel groove 22 may cooperate with lower side grooves 12 of the impeller 10 to define a second chamber. Therefore, the second channel groove 22 will be hereinafter also called "second chamber 22." The first chamber 21 and the second chamber 22 may define a pump chamber.

The pump casing 6 defines a second inlet port 21*e* disposed at one end of the second chamber 22 in the direction opposite to the rotational direction of the impeller 10. A second outlet port 22*p* may be defined at the other end of the second chamber 22 in the rotational direction of the impeller 10.

The second inlet port 22*e* and the second outlet port 22*p* may be separated from each other by a partition wall 6*q* of the pump casing 6.

Referring to FIG. 4, a suction channel 24 may be defined in the pump casing 6 and the upstream-side end of the suction channel 24 may open to the outside via a suction opening 25. The suction opening 25 may be positioned at the lower end of the pump casing 6. The downstream side of the suction channel 24 may be branched into an upper branch channel 24*a* and a lower branch channel 24*b*. The upper branch channel 24*a* may communicate with the first inlet port 21*e* of the first pump channel 21. The lower branch channel 24*b* may communicate with the second inlet port 22*e* of the second chamber 22. Preferably, the first inlet port 21*e* and the second inlet port 22*e* may be positioned at the same position as viewed in plan view, i.e., as viewed in the direction parallel to the rotational axis of the impeller 10.

Referring again to FIG. 4, a discharge channel 26 may be defined in the pump casing 6 and the downstream-side end of the discharge channel 26 may open into the inner space 2*a* via a discharge opening 27. The discharge opening 27 may be positioned at the upper end of the pump casing 6. The upstream side of the discharge channel 26 may be branched into an upper branch channel 26*a* and a lower branch channel 26*b*. The upper branch channel 26*a* may communicate with the first outlet port 21*p* of the first chamber 21. The lower branch channel 26*b* may communicate with the second outlet port 22*p* of the second chamber 22. Preferably, the first outlet port 21*p* and the second outlet port 22*p* may be positioned at the same position as viewed in plan view, i.e., as viewed in the direction parallel to the axial direction of the rotational axis of the impeller 10 (see also FIG. 1(A).

The operation of the first representative impeller pump will now be described. The armature 5 may rotate when a power is supplied to the coil (not shown) of the armature 5 via the terminals and brushes. Therefore, the impeller 10 as well as the shaft 5*a* of the armature 5 may rotate in a direction as indicated by outline arrows in FIG. 1(A) and FIGS. 2(A) to 2(C). A pumping operation may be performed as the impeller 10 rotates. Thus, as the impeller 10 rotates, a fuel, e.g., gasoline, stored within a fuel tank (not shown) may be drawn into the pump casing 6 via the suction channel 24. The fuel may then flow into the upper branch channel 24*a* and the lower branch channel 24*b*. The fuel may further flow into the first chamber 21 and the second chamber 22 via the first inlet port 21*e* and the second inlet port 22*e*, respectively.

The fuel that enters the first chamber 21 and the second pump camber 22 may then be pressurized to be fed toward the first outlet port 21*p* and the second port 22*p*, due to the kinetic energy that is applied by the grooves 12 or the vanes defined by the grooves 12. Because each of the grooves 12 formed on one side of the impeller 10 communicates with one of the groove 12 on the opposite side via the communication hole 18, the first chamber 21 and the second chamber 22 communicate with each other. As a result, the pressure of the fuel within the first chamber 21 and the pressure of the fuel within the second chamber 22 become substantially equal to each other.

In addition, because the group of the grooves 12 on one side of the impeller 10 is offset by the distance of substantially half the pitch between two adjacent grooves 12 in the circumferential direction, the phase of pulsation of the fuel that is discharged from the first discharge port 21*p* of the first chamber 21 may be shifted in phase by half or about half the cyclic period (about 180°) from the phase of pulsation of the fuel that is discharged from the second outlet port 22*p* of the second chamber 22.

A pulsation P1 of the fuel discharged from the first outlet port 21*p* of the first chamber 21 may be schematically shown in a graph on the upper side of FIG. 1(B). A pulsation P2 of the fuel discharge from the second outlet port 22*p* of the second chamber 22 may be schematically shown in the graph on the lower side of FIG. 1(B). In FIG. 1(B), the ordinate axis represents the pressure of the fuel and the abscissa axis represents the time.

The fuel that is discharged from the first outlet port 21*p* of the first chamber 21 may flow into the discharge channel 26 via the upper branch channel 26*a*. On the other hand, the fuel that is discharged from the second outlet port 22*p* of the second chamber 22 may flow into the discharge channel 26 via the lower branch channel 26*b*.

As described above, the phase of pulsation of the fuel that flows into the discharge channel 26 via the upper branch channel 26*a* may be shifted in phase by half or about half the cyclic period (about 180°) relative to the phase of pulsation of the fuel that flows into the discharge channel 26 via the lower branch channel 26*b*. Therefore, the pulsation of the fuel discharged from the upper branch channel 26*a* and the pulsation of the fuel discharged from the lower branch channel 26*b* may be canceled each other when the flows of the fuel meet or converge at the discharge channel 26, i.e., a converging point of the flows. As a result, noises that may be produced by the pulsations of the fuel may be reduced or minimized.

The fuel converged at the discharge channel 26 may flow into the inner space 2*a* of the motor section 2 via the discharge opening 27. The fuel may further flow to be delivered to the fuel pipe (no shown) from the inner space 2*a* via the discharge port 8 defined in the motor cover 7. The flow path of the fuel is indicated by arrows in FIG. 4.

According the first representative impeller pump, the phase of pulsation of the fuel that is discharged from the first chamber 21 via the first outlet port 21*p* may be shifted by half the pulse length relative to the phase of pulsation of the fuel that is discharged from the second chamber 22 via the second outlet port 22*p*. The pulsations may be canceled or minimized when the flows of the fuel converge at the discharge channel 26 or the converging point.

Figure 5:
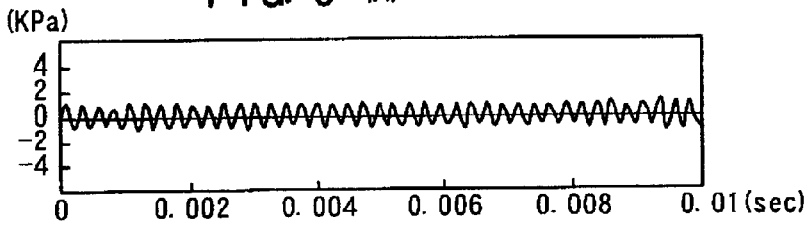
FIG. 5(A) is a graph showing the measured pressure of the fuel discharged from the first chamber.
FIG. 5(B) is a graph showing the measured pressure of the fuel discharged from the second chamber.
FIG. 5(C) is a graph showing the measured pressure of the fuel at a discharge channel or a converging channel.
FIG. 5(D) is a graph showing the relation between an amplitude of pulsation and the ratio of a cross sectional area of a communication hole to an open area of an opening of each grooves of the impeller.
Figure 5:
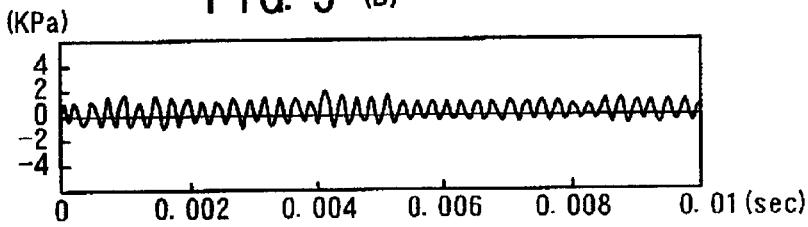
Figure 5:
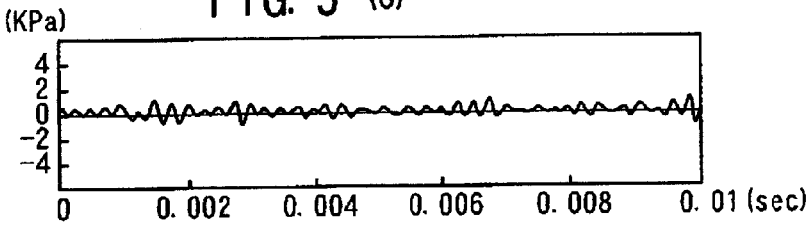
Figure 5:
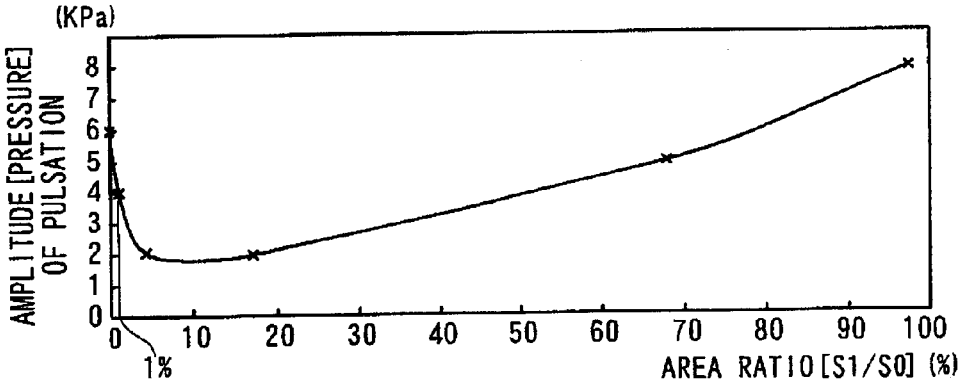

FIGS. 5(A) to 5(C) show experimental results of an impeller pump designed according to the teachings of the first representative impeller pump. FIG. 5(A) shows the variation in pressure (pulsation component only) of the fluid that is discharged from the first outlet port 21*p* of the first chamber 21. FIG. 5(B) shows the variation in pressure (pulsation component only) of the fluid that is discharged from the second discharge port 22*p* of the second chamber 22. FIG. 5(C) shows the variation in pressure of the fuel after the flows of the fuel have been converged at the discharge channel 26.

The experimental results indicated that the amplitude of pulsation may be reduced to be less than about 2 kPa.

FIG. 5(D) also shows the experimental result with regard to the relation between the ratio (S1/S0) (%) (ratio of the cross sectional area S1 of the communication hole 18 to the open area S0 of each groove 21) and the amplitude of the pulsation. This experimental result indicated that the amplitude of pulsation may be reduced to be less than about 2 kPa when the ratio S1/S0 is chosen within the range of about 3% to about 18%. Even if the ratio S1/S0 is within the range of about 1% to about 70%, the amplitude of pulsation may still be reduced to be less than about 4.5 kPa. In the conventional impeller pumps (Westco pumps), the amplitude of pulsation is about 8 kpa. Therefore, the selection of the ratio S1/S0 to be within the range of about 1% to about 70% still provides a significant pulsation reduction effect.

In order to shift the phase of pulsation of the fuel discharged from the first chamber 21 by half the cyclic period of the pulsation relative to the phase of pulsation of the fuel discharged from the second chamber 22, the group of grooves 12 on one side of the impeller 10 of the first representative impeller pump is offset by a distance of half the pitch of the grooves 12 relative to group of grooves 12 on the other side of the impeller 10. However, such a shift of phase may be attained also by the arrangement shown FIG. 6(A).

Figure 6:
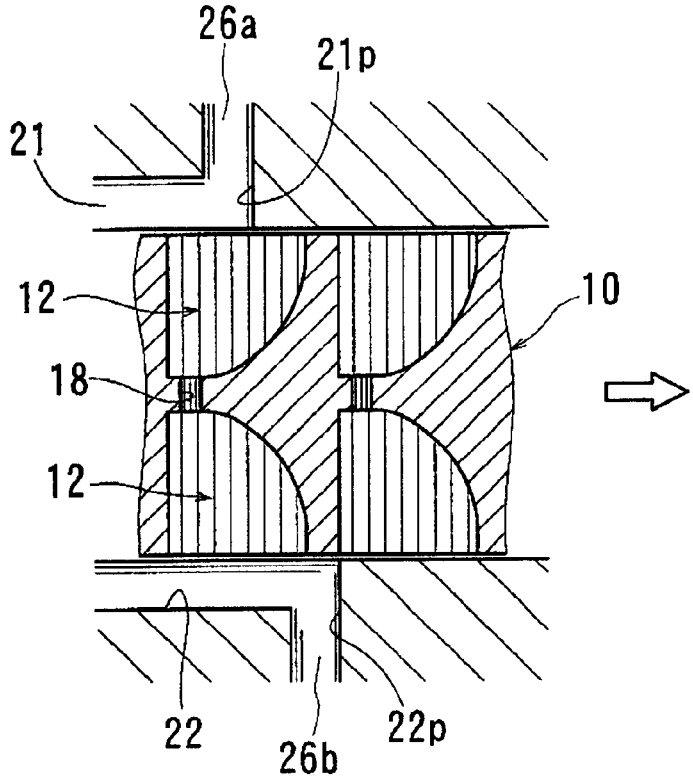
FIG. 6(A) is an enlarged vertical sectional view of a modification of the first representative impeller pump.
FIG. 6(B) is a graph schematically showing a pulsation of a fuel discharged from a first chamber and a pulsation of a fuel discharged from a second chamber according to the modification of the first representative impeller pump.
Figure 6:
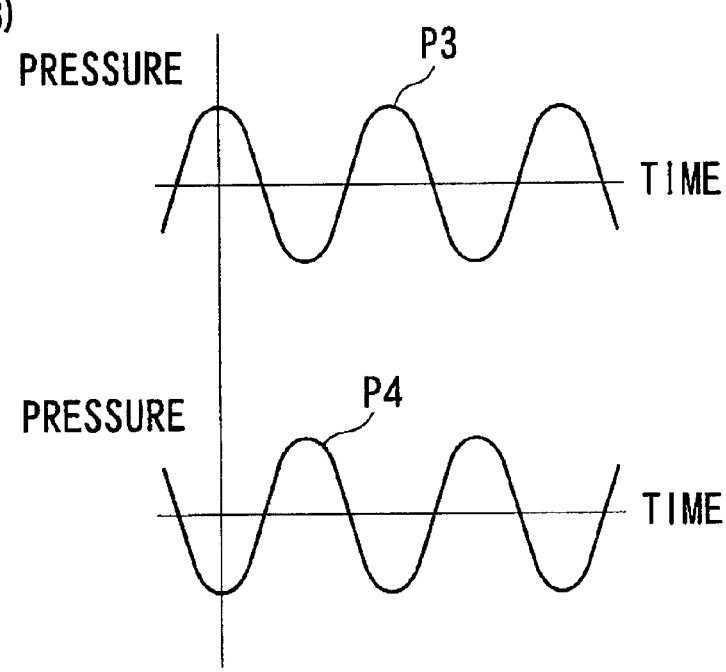
Figure 7:
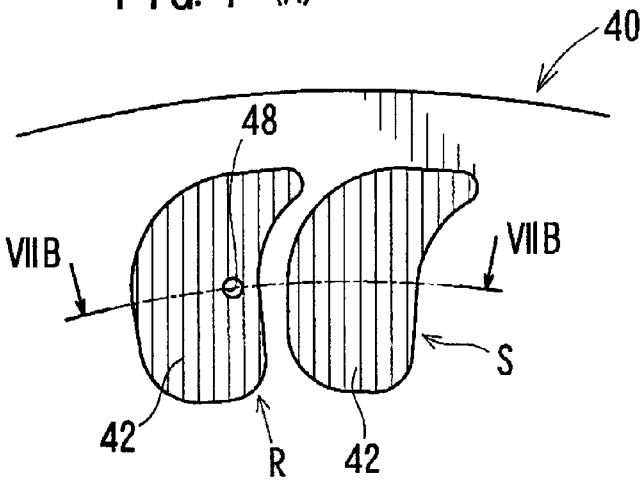
FIG. 7(A) is an enlarged plan view of a region indicated by an arrow VIIA in FIG. 7(C) of an impeller of a second representative impeller pump.
FIG. 7(B) is a sectional view taken along line VIIB—VIIB in FIG. 7(A)
FIG. 7(C) is a plan view of the impeller.
Figure 7:
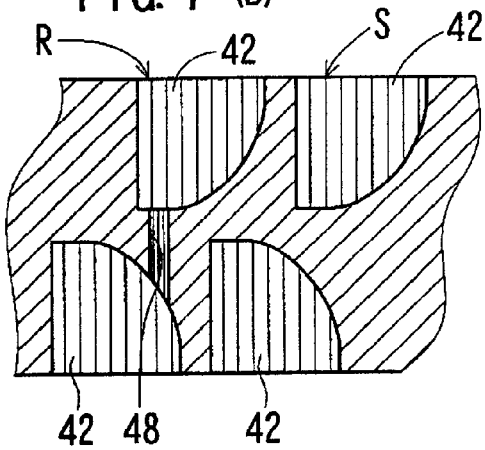
Figure 7:
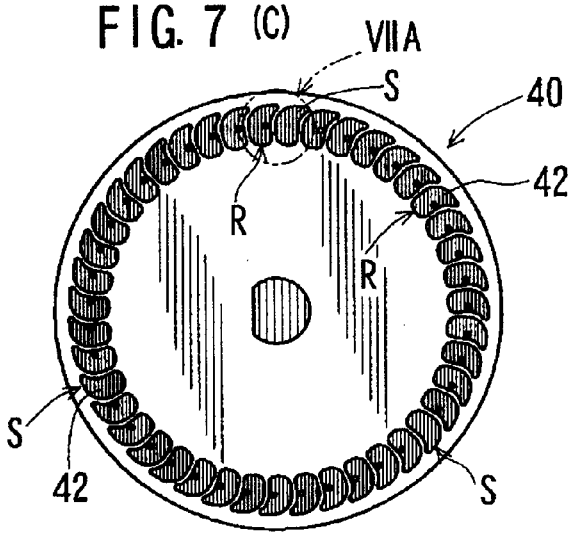
Figure 8:
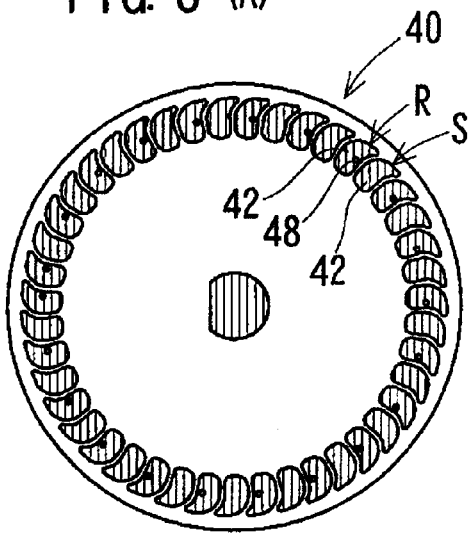
FIGS. 8(A), 8(B), 8(C) and 8(D) are plan views of impellers according to modifications of the second representative impeller pump.
Figure 8:
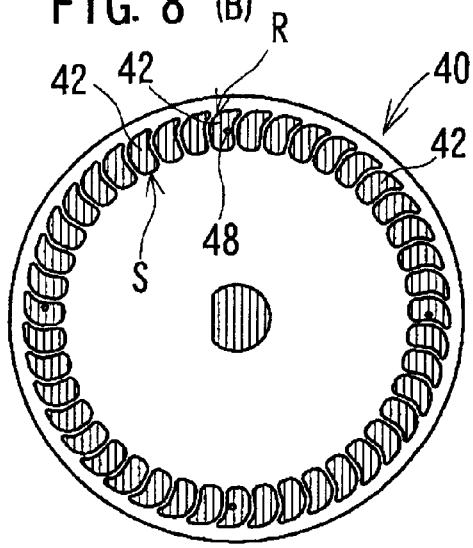
Figure 8:
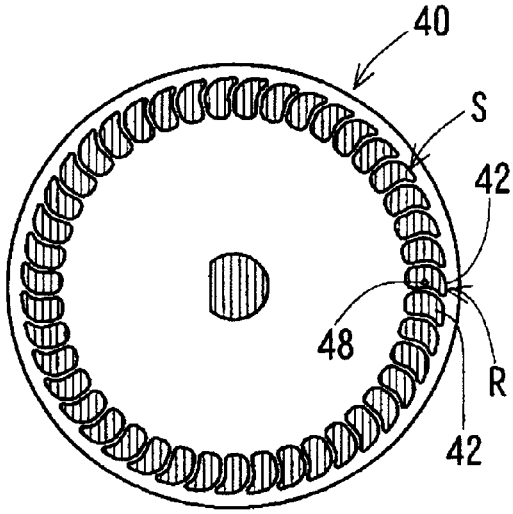
Figure 8:
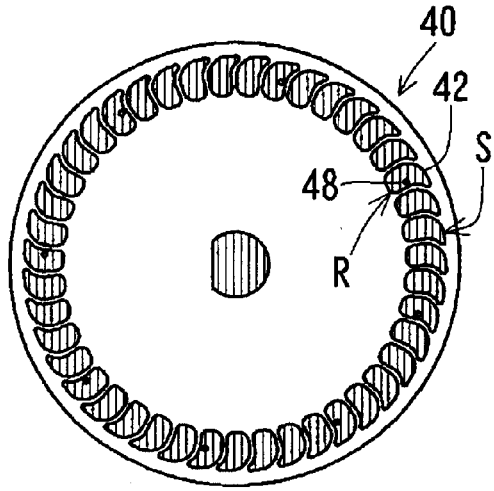
Figure 9:
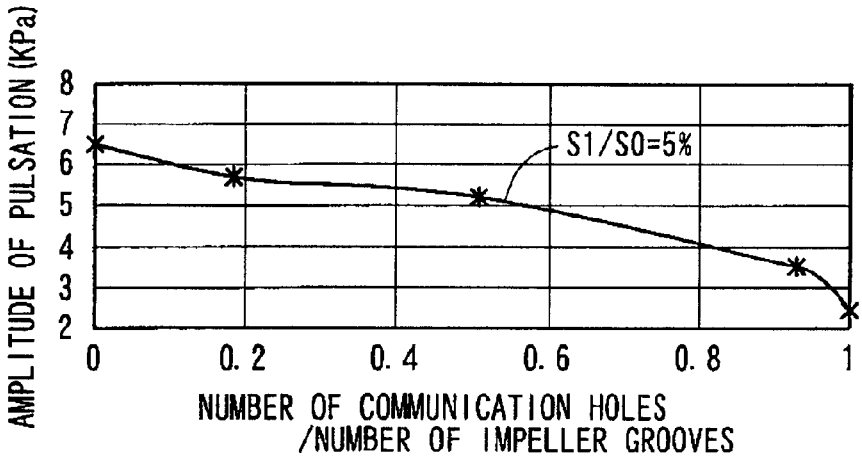
FIG. 9(A) is a graph showing the relation between an amplitude of pulsation and a ratio of the number of communication holes to the number of grooves formed in the impeller.
FIG. 9(B) is a graph showing the relation between the amplitude of pulsation and a ratio of a cross sectional area of a communication hole to an open area of an opening of each groove of the impeller.
Figure 9:
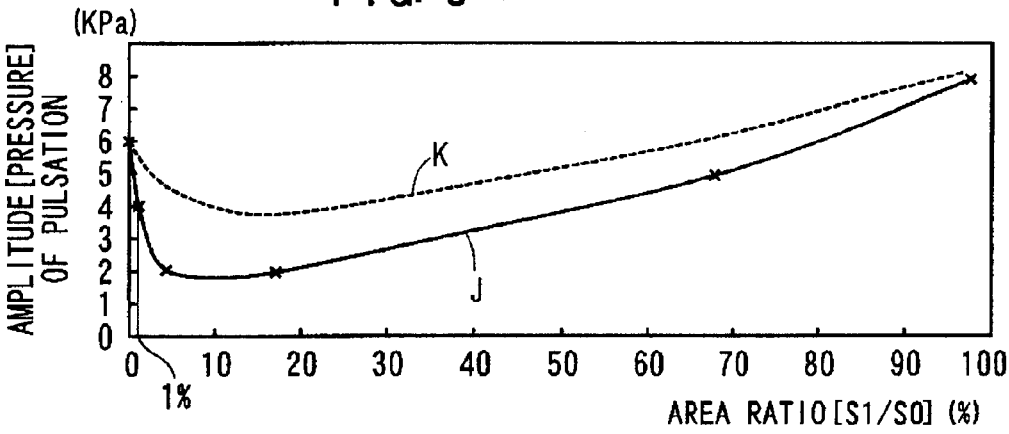
Figure 10:
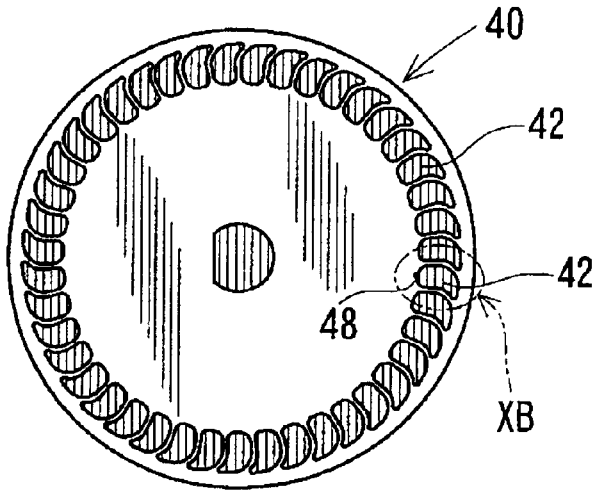
FIG. 10(A) is a plan view of an impeller according to a first modification of the second representative impeller pump.
FIG. 10(B) is an enlarged plan view of a region indicated by an arrow XB in FIG. 10(A) of the impeller shown in FIG. 10(A).
FIG. 10(C) is a sectional view taken along line XC—XC in FIG. 10(B)
Figure 10:
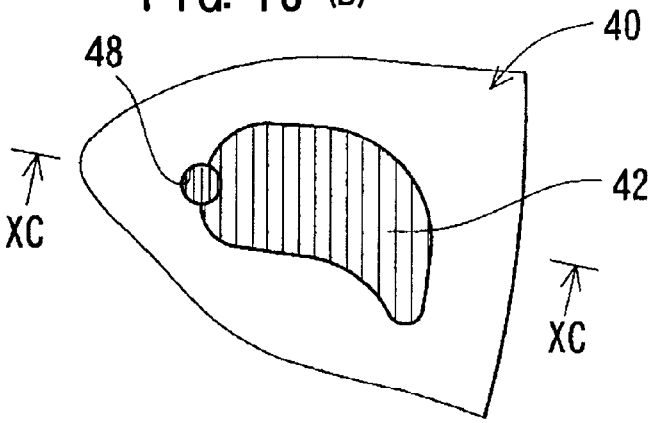
Figure 10:
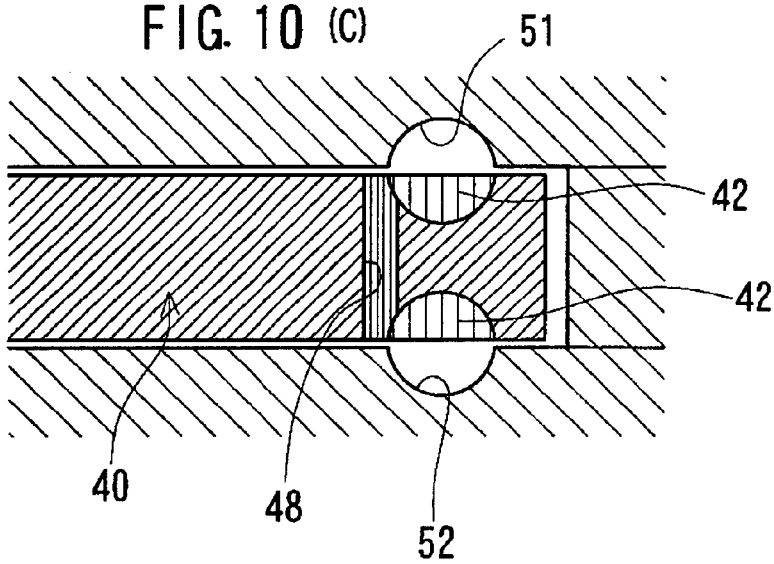
Figure 11:
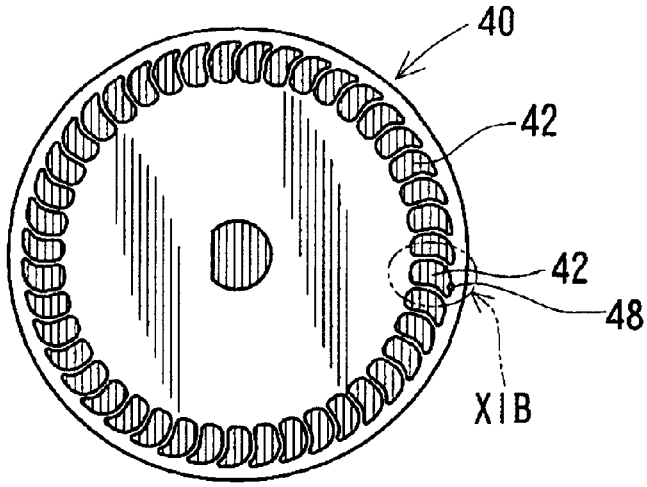
FIG. 11(A) is a plan view of an impeller according to a second modification of the second representative impeller pump.
FIG. 11(B) is an enlarged plan view of a region indicated by an arrow XIB in FIG. 11(A) of the impeller shown in FIG. 11(A)
FIG. 11(C) is a sectional view taken along line XIC—XIC in FIG. 11(B)
Figure 11:
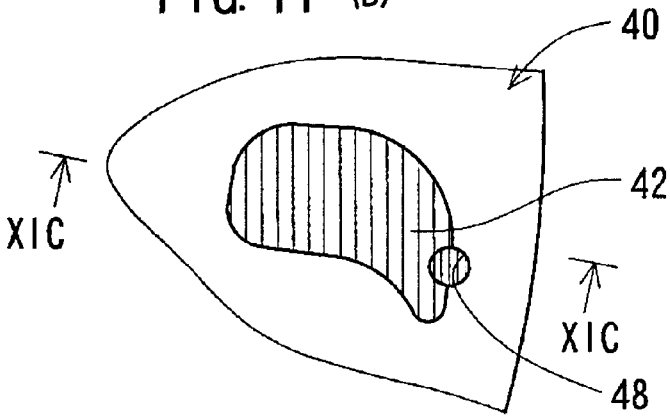
Figure 11:
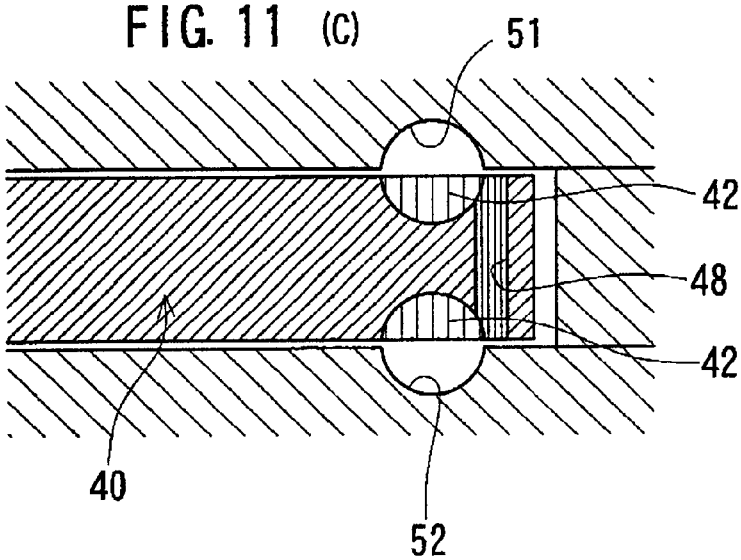
Figure 12:
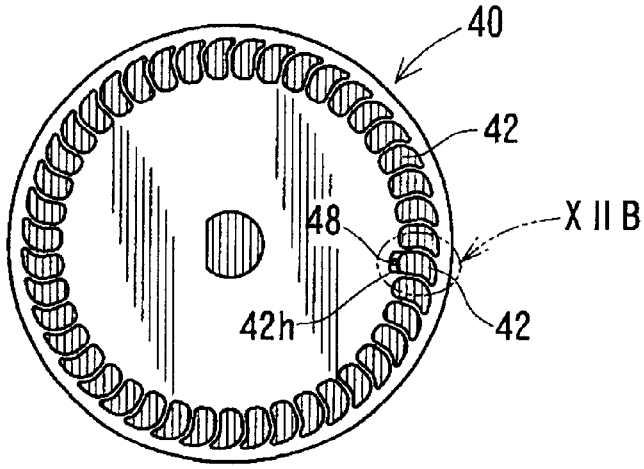
FIG. 12(A) is a plan view of an impeller according to a third modification of the second representative impeller pump.
FIG. 12(B) is an enlarged plan view of a region indicated by an arrow XIIB in FIG. 12(A) of the impeller shown in FIG. 12(A)
FIG. 12(C) is a sectional view taken along line XIIC—XIIC in FIG. 12(B)
Figure 12:
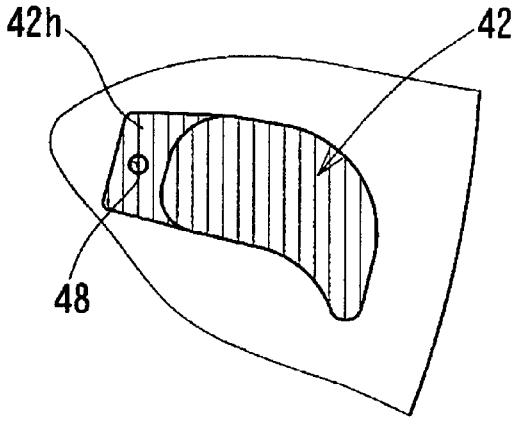
Figure 12:
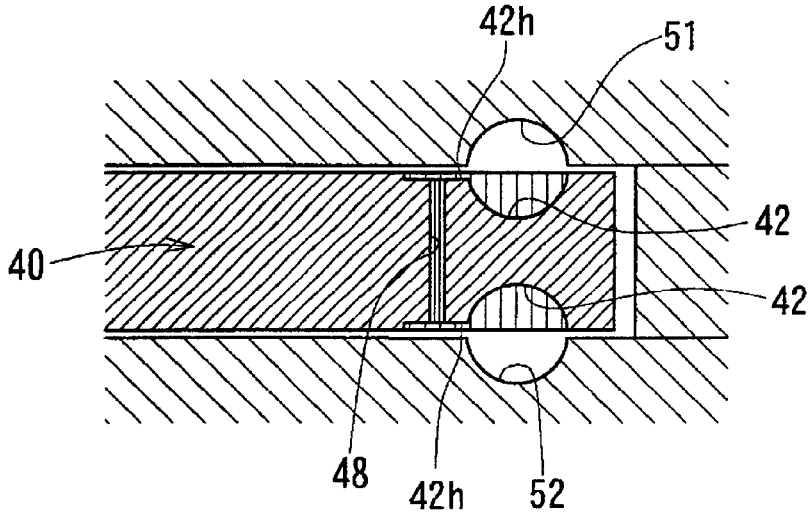
Figure 13:
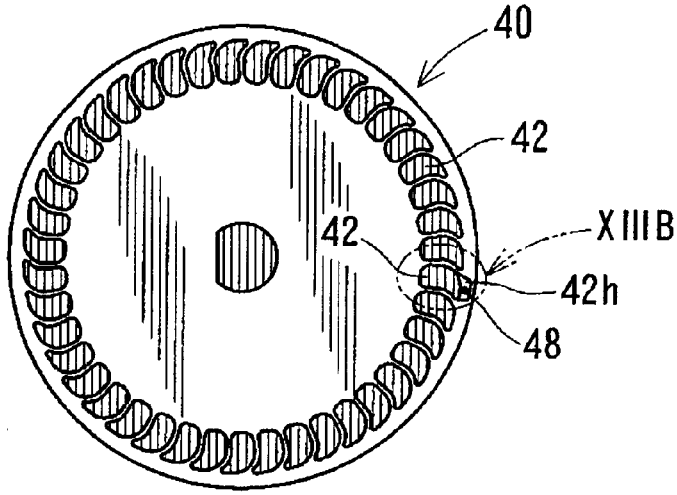
FIG. 13(A) is a plan view of an impeller according to a fourth modification of the second representative impeller pump.
FIG. 13(B) is an enlarged plan view of a region indicated by an arrow XIIIB in FIG. 13(A) of the impeller shown in FIG. 13(A)
FIG. 13(C) is a sectional view taken along line XIIIC—XIIIC in FIG. 13(B)
Figure 13:
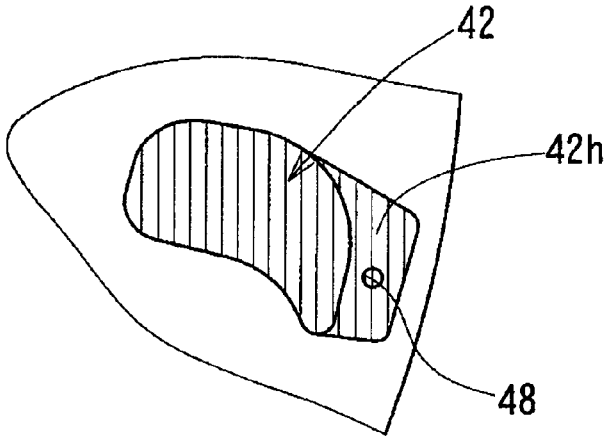
Figure 13:
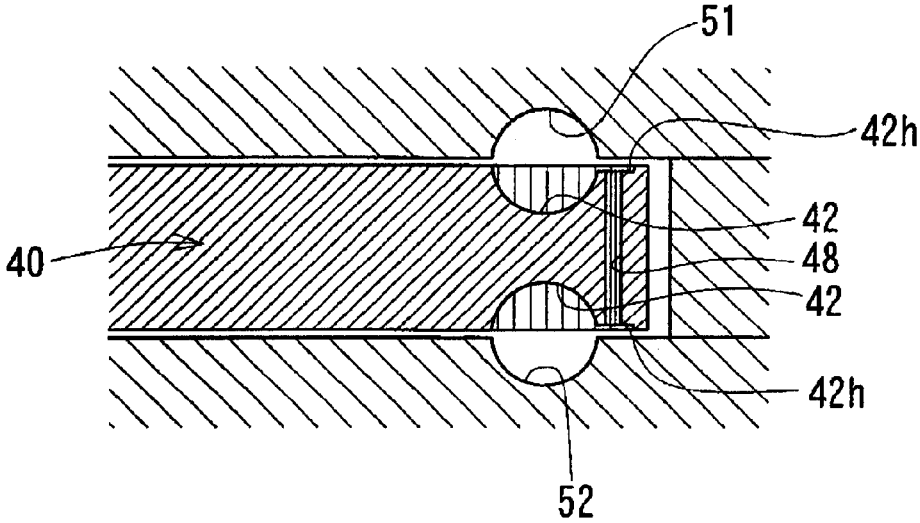
Figure 14:
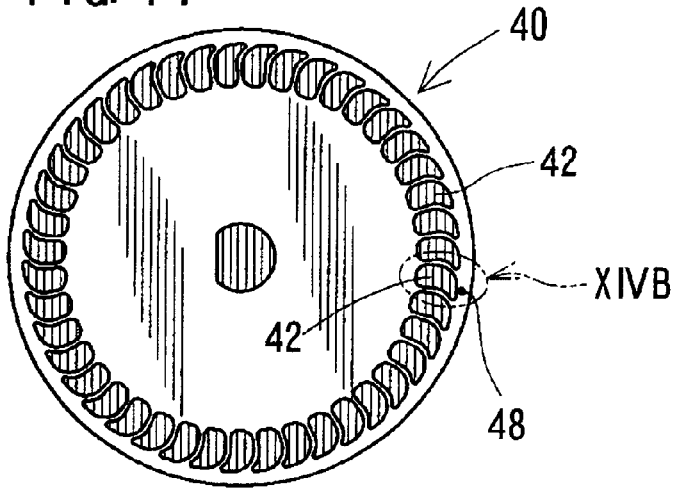
FIG. 14(A) is a plan view of an impeller according to a fifth modification of the second representative impeller pump.
FIG. 14(B) is an enlarged plan view of a region indicated by an arrow XIVB in FIG. 14(A) of the impeller shown in FIG. 14(A)
FIG. 14(C) is a sectional view taken along line XIVC—XIVC in FIG. 14(B)
Figure 14:
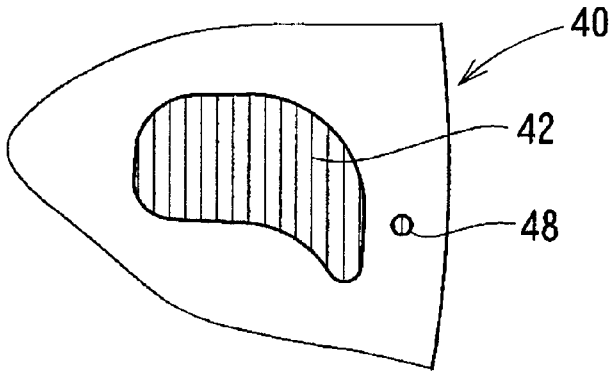
Figure 14:
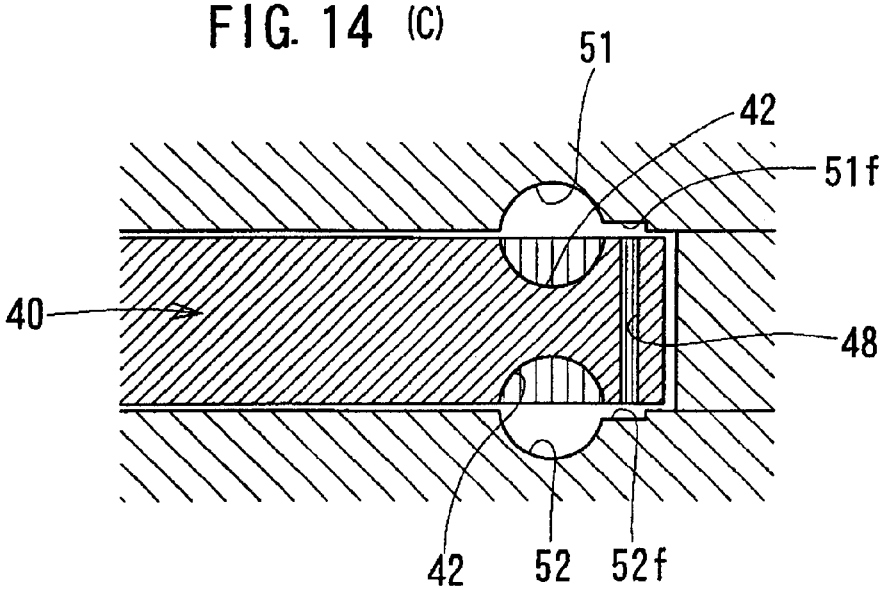
Figure 15:
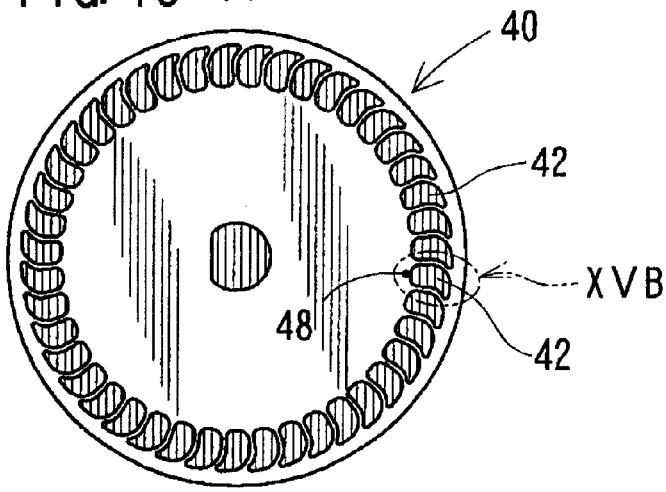
FIG. 15(A) is a plan view of an impeller according to a sixth modification of the second representative impeller pump.
FIG. 15(B) is an enlarged plan view of a region indicated by an arrow XVB in FIG. 15(A) of the impeller shown in FIG. 15(A)
FIG. 15(C) is a sectional view taken along line XVC—XVC in FIG. 15(B)
Figure 15:
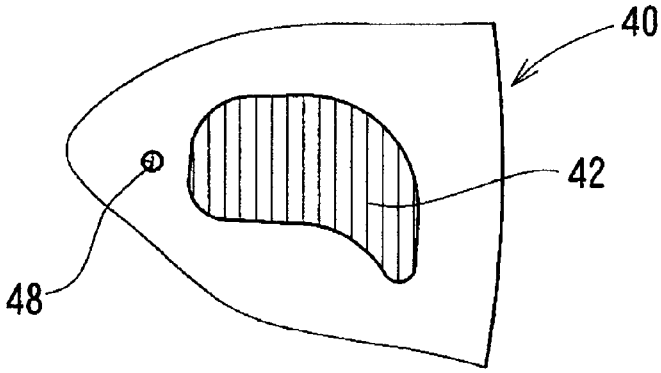
Figure 15:
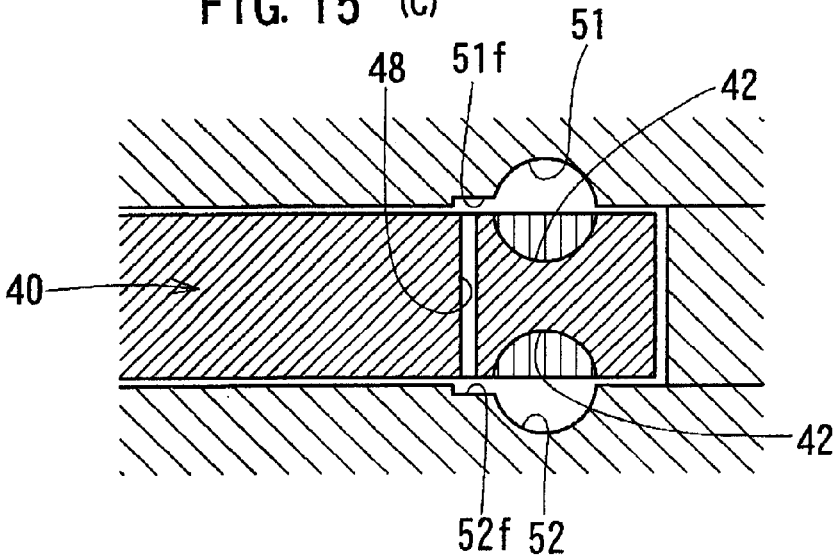
Figure 16:
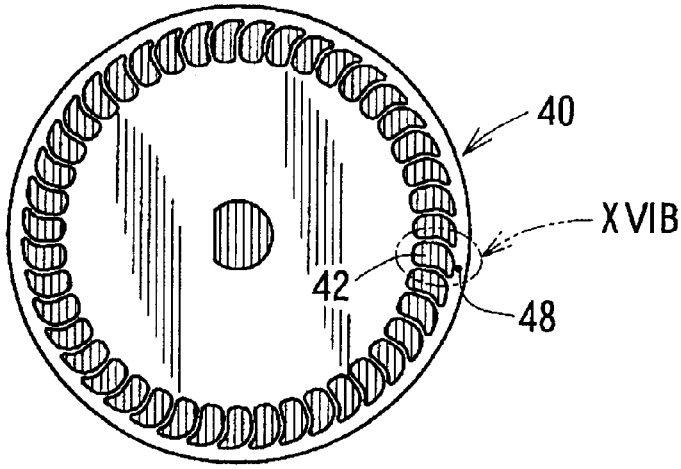
FIG. 16(A) is a plan view of an impeller according to a seventh modification of the second representative impeller pump.
FIG. 16(B) is an enlarged plan view of a region indicated by an arrow XVIB in FIG. 16(A) of the impeller shown in FIG. 16(A)
FIG. 16(C) is a sectional view taken along line XVIC—XVIC in FIG. 16(B)
Figure 16:
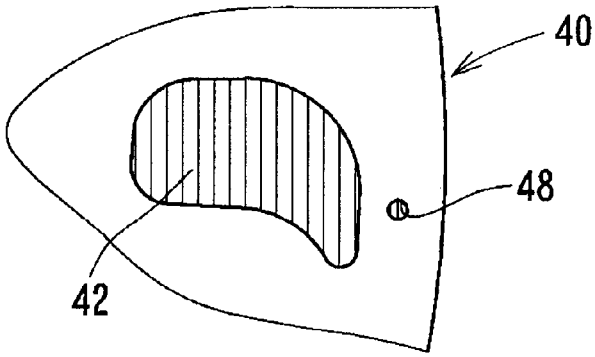
Figure 16:
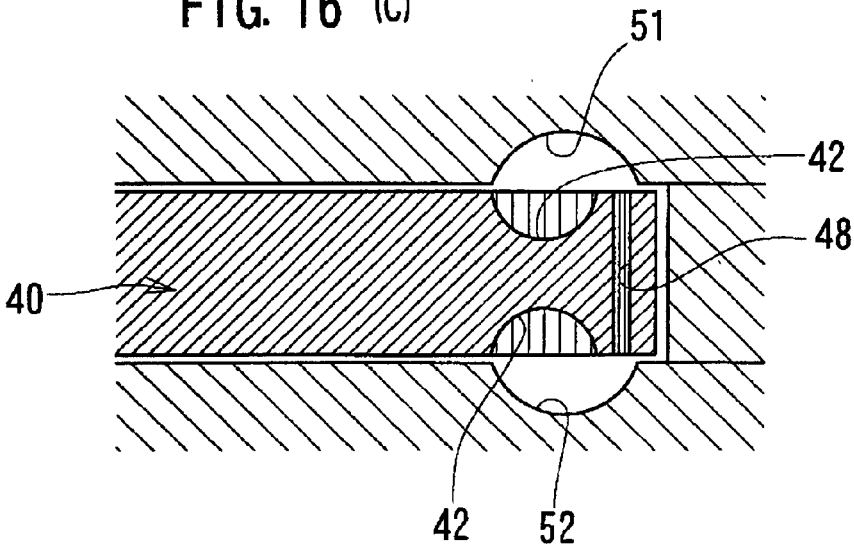
Figure 17:
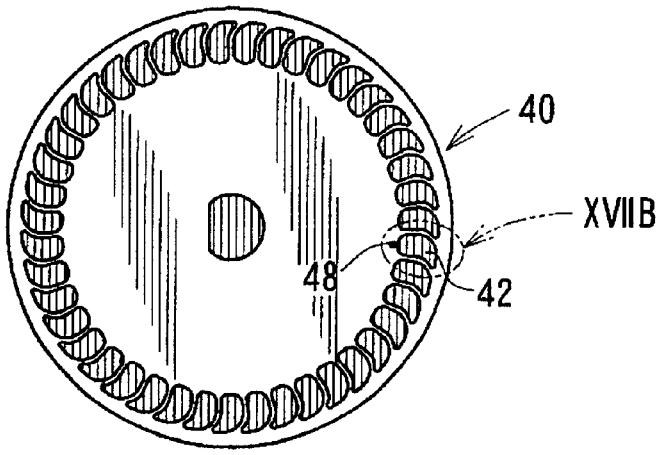
FIG. 17(A) is a plan view of an impeller according to an eighth modification of the second representative impeller pump.
FIG. 17(B) is an enlarged plan view of a region indicated by an arrow XVIIB in FIG. 17(A) of the impeller shown in FIG. 17(A)
FIG. 17(C) is a sectional view taken along line XVIIC—XVIIC in FIG. 17(B)
Figure 17:
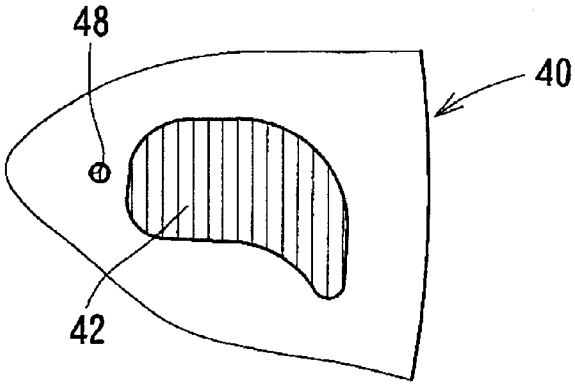
Figure 17:
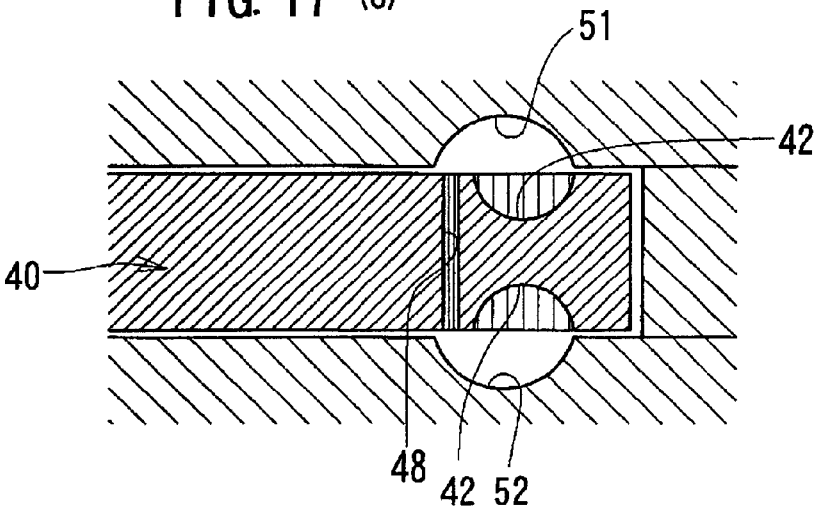
Figure 18:
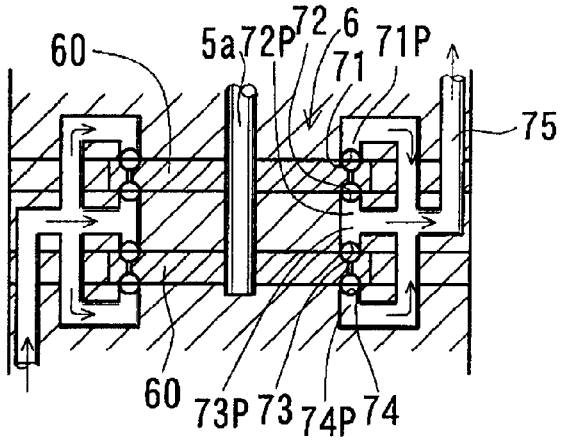
FIG. 18(A) is a schematic vertical sectional view of a pump section of a third representative impeller pump.
FIG. 18(B) is an enlarged vertical sectional view of the pump section.
FIG. 18(C) is a graph showing the relation among phases of pulsations of a fuel discharged from a first chamber and a second pump channel of a first pumping stage and phases of pulsations of a fuel discharged from a first chamber and a second chamber of a second pumping stage.
Figure 18:
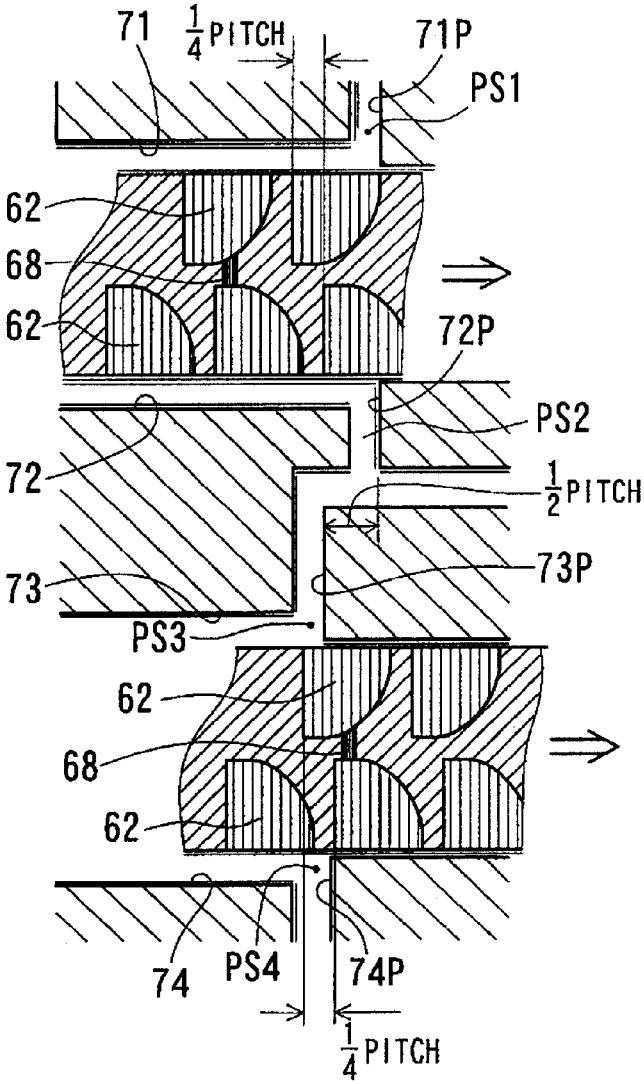
Figure 18:
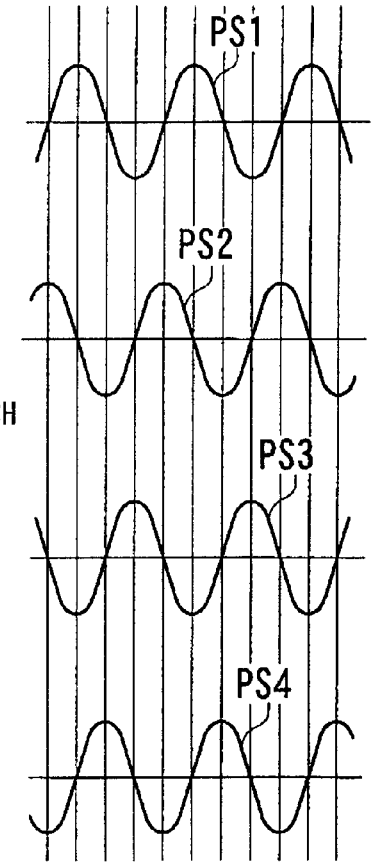
Figure 19:
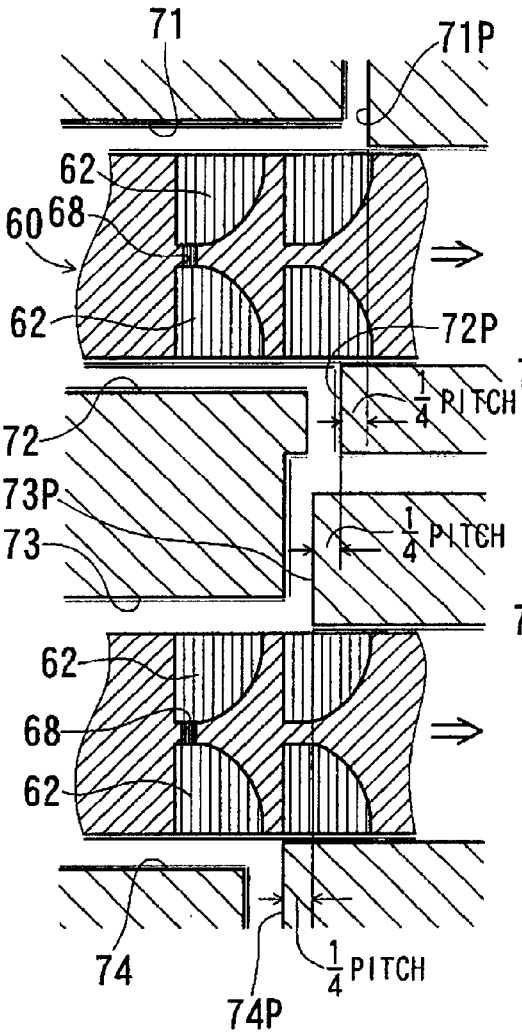
FIG. 19(A) is an enlarged vertical sectional view of a pump section according to a first modification of the third representative impeller pump.
FIG. 19(B) is an enlarged vertical sectional view of a pump section according to a second modification of the third representative impeller pump.
Figure 19:
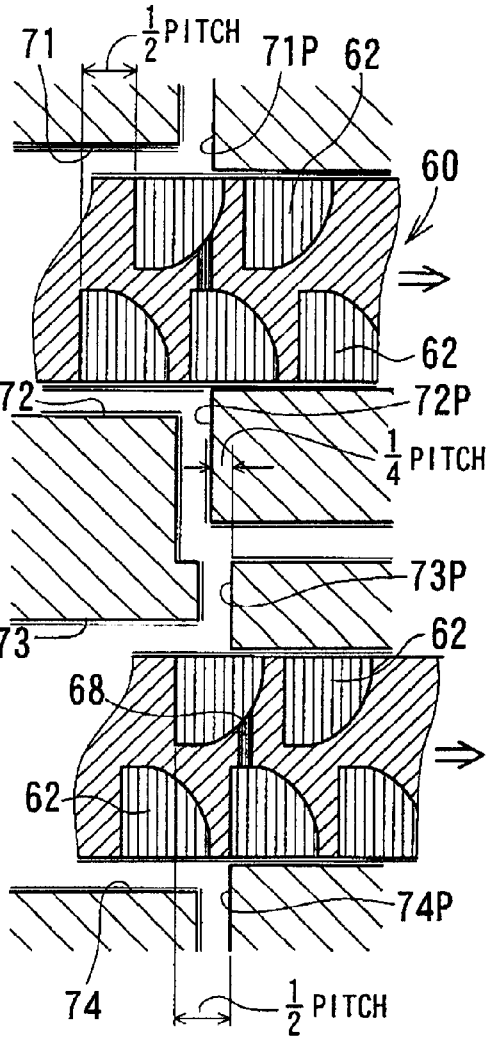
Figure 20:
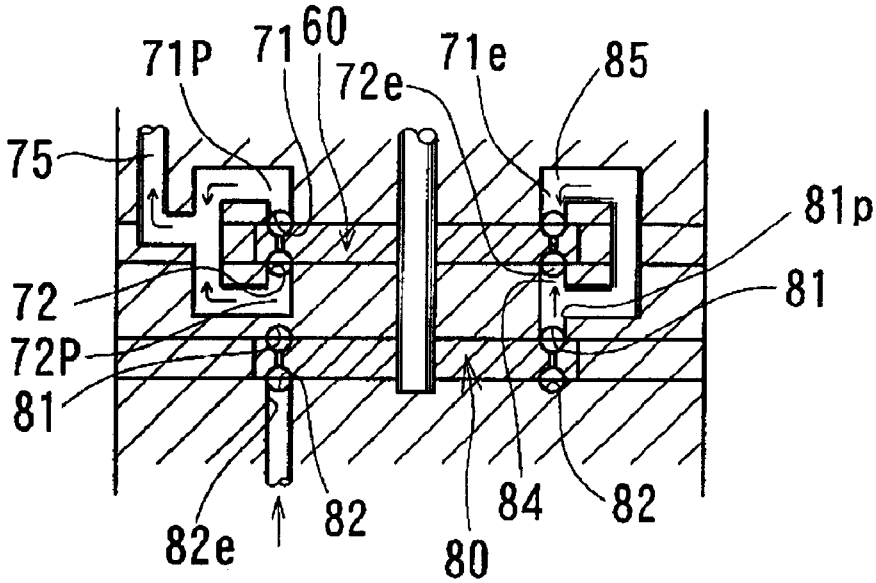
FIG. 20(A) is a schematic vertical sectional view of a pump section according to a third modification of the third representative impeller pump.
FIG. 20(B) is an enlarged vertical sectional view of a portion including a second impeller according the modification shown in FIG. 20(A).
Figure 20:
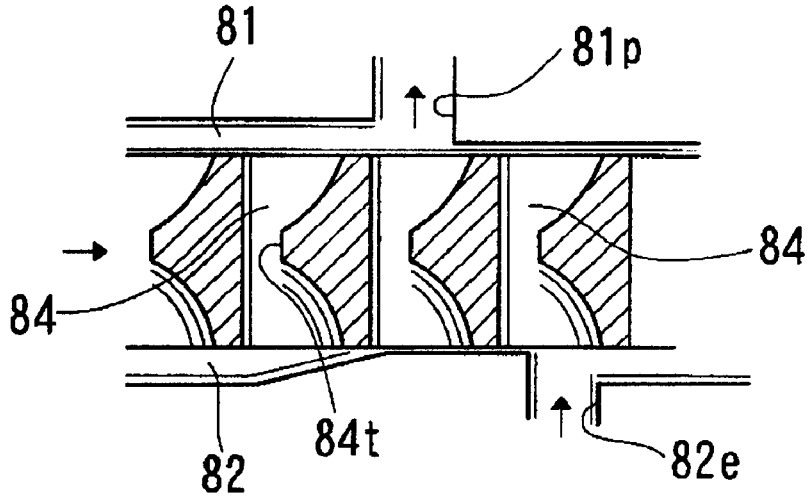

Thus, FIG. 6(A) shows a sectional view of a part of an impeller pump that is a modification of the first representative impeller pump. In this modification, the grooves 12 on one side of the impeller 10 are positioned to align in the axial direction (or align as viewed in plan view) with the corresponding grooves 12 on the other side of the impeller 10. On the other hand, the first outlet port 21*p* of the first chamber 21 may be offset by a distance of half the pitch of the grooves 12 relative to the second outlet port 22*p* of the second pump channel 22. A pulsation P3 of the fuel discharged from the first outlet port 21*p* of the first chamber 21 of the modified impeller pump may be schematically shown in a graph on the upper side of FIG. 6(B). A pulsation P3 of the fuel discharge from the second outlet port 22*p* of the second chamber 22 may be schematically shown in a graph on the lower side of FIG. 6(B). In FIG. 6(B), the ordinate axis represents the pressure of the fuel and the abscissa axis represents the time. As will be seen from FIG. 6(B), the phase of the pulsation of the fuel discharged from the second chamber 22 may be shifted by half the cyclic period pulse of the pulsation relative to the phase of pulsation of the fluid discharged from the first chamber 21.

In addition, the front edge 13*f* and the rear edge 13*b* of the opening 13 of each groove 12 of the impeller 10 may have inner portions on the side of the inner edge 13*e*, which inner portions extend substantially in the radial direction of the impeller 10. Furthermore, the front edge 13*f* and the rear edge 13*b* have outer portions on the side of the inner edge 13*e*, which outer portions are curved toward the front side in the rotational direction of the impeller 10. Therefore, the pumping efficiency may be improved.

The configuration of the opening 13 of the groove 12 may be modified in various ways as long as the opening has the front edge 13*f* and the rear edge 13*b* configured as described above. For example, the opening 13 may have a substantially square or rectangular configuration.

A second representative impeller pump will now be described with reference to FIGS. 7(A) and 7(B) to FIGS. 17(A), 17(B) and 17(C). The second representative impeller pump may be different from the first representative impeller pump shown in FIGS. 1(A) and 1(B) to FIG. 4 in the arrangement and the number of the communication holes that extend between the grooves on the opposite sides of the impeller. Otherwise, the second representative impeller pump may be the same as the first representative impeller pump. Therefore, in FIGS. 7(A) and 7(B) to FIGS. 17(A), 17(B) and 17(C), like members are given the same reference numerals and an explanation of these members will not be necessary.

Referring to FIGS. 7(A) to 7(C), an impeller 40 of the second representative impeller pump may have a group of grooves 42 formed in each of upper and lower surfaces of the impeller 40. Almost of the grooves 42 on one side of the impeller 40 may communicate with the corresponding axially opposing grooves 42 via communication holes 48. Therefore, a first pump channel or a fist pump chamber 51 (see FIG. 10(C)) may communicate with a second pump channel or a first chamber 52 (see also FIG. 10(C)) via the communication holes 48.

As shown in FIG. 7(C), the number of the grooves 42 that communicate with the communication holes 48 may be greater than the number of the grooves 42 that do not communicate with the communication holes 48. The pair of opposing grooves 42 that communicate with the communication holes 48 will be hereinafter called "first groove pairs R." The opposing grooves 42 that do not communicate with the communication holes 48 will be hereinafter called "second groove pairs S." In the second representative impeller pump, three second groove pairs S may be provided, although four or more second groove pairs S may be provided. The second groove pairs S of the impeller 40 may be equally spaced from each other in the circumferential direction, so that the balance of pressure in the circumferential direction may be obtained.

Various modifications of the second representative impeller pump may be shown in FIGS. 8(A) to 8(D). In the modification show in FIG. 8(A), the fist groove pairs R and the second groove pairs S are arranged alternatively in the circumferential direction. In the modifications shown in FIGS. 8(B) to 8(D), the number of the second groove pairs S is larger than the number of the first groove pairs R. In the modification shown in FIG. 8(B), four first groove pairs R are arranged to be spaced equally in the circumferential direction. In the modification shown in FIG. 8(C), only one first groove pair R is provided. In the modification shown in FIG. 8(D), eight first groove pairs R are arranged to be spaced equally in the circumferential direction.

FIGS. 9(A) and 9(B) are graphs showing the results of experiments that were conducted for various impeller pumps designed according to the second representative embodiment. More specifically, the graph of FIG. 9(A) shows the relation between the ratio of the number (N1) of communication holes 48 (i.e., the number of the first groove pairs R) to the number (N2) of all the grooves 42 and the resulted amplitude of the pulsation (kPa). Throughout the experiments, the ratio S1/S0 (the ratio of the cross sectional area S1 of the communication hole 48 to the open area of the groove 42) is set to be about 5%.

As will be seen from FIG. 9(A), the amplitude of the pulsation becomes minimum when the ratio N1/N2 is 1, i.e. when all pairs of the opposing grooves 42 are designed to be the first groove pairs R that communicate with the communication holes 48.

FIG. 9(B) is a graph showing the relation between the ratio S1/S0 (%) and the amplitude of pulsation (kPa). A solid line J indicates the relation in case that the ratio N1/N2 is 1. A dotted line K indicates the relation in case that the ratio N1/N2 is 0.5.

The experimental results shown in FIGS. 9(A) and 9(B) may indicate the amplitude of the pulsation becomes minimum when (1) the ratio N1/N2 is 1, i.e., all pairs of the grooves 42 are designed to be the first groove pairs R and (2) the ratio S1/S0 is about 5%.

Another modification of the second representative impeller pump is shown in FIGS. 10(A) to 10(C). In this modification, the communication hole 48 does not extend from inside of the axially opposing pair of the grooves 42 but may extend from inner edges of the opposing grooves 42.

Although only one pair of the axially opposing grooves 42 may communicate with the communication hole 48 in this modification, two or more or all of the opposing pairs of the grooves 42 may communicate with their respective communication holes 48.

An additional modification of the second representative impeller pump is shown in FIGS. 11(A) to 11(C). In this modification, the communication hole 48 does not extend from inside of the axially opposing pair of the grooves 42 but may extend from outer edges of the opposing grooves 42.

A further modification of the second representative impeller pump is shown in FIGS. 12(A) to 12(C). In this modification, shallow grooves 42*h* may be formed on both upper and lower surfaces of the impeller 40. The shallow grooves 42*h* may be formed in continuity with the inner edges of the axially opposing pair of the grooves 42 of the impeller 40. The communication hole 48 may extend from the shallow grooves 42*h*, so that the first chamber 51 on one side of the impeller 40 may communicate with the second chamber 52 on the other side of the impeller 40 via the shallow grooves 48 and the communication hole 48. Although the shallow grooves 48 and the communication hole 48 may be formed in association with only one opposing pair of the grooves 42 in this modification, the shallow grooves 48 and the communication hole 48 may be formed to be associated with each of plural pairs of the opposing grooves 42.

A further modification of the second representative impeller pump is shown in FIGS. 13(A) to 13(C). This modification is different from the modification shown in FIGS. 12(A) to 12(C) in that the shallow grooves 42*h* may be formed in continuity with the outer edges of the axially opposing pair of the grooves 42.

Further various modifications of the second representative impeller pump are shown in FIGS. 14(A), 14(B) and 14(C) to FIGS. 17(A), 17(B) and 17(C). In each of these modifications, the communication hole 48 may be positioned adjacent to the outer edges or the inner edges of the axially opposing pair of the grooves 42 but may not interfere with the groove 42. In this connection, the first chamber 51 may be configured to extend over the communication hole 42 as well as the group of grooves 42 on one side of the impeller 40. Similarly, the second chamber 52 may be configured to extend over the communication hole 42 as well as the group of grooves 42 on the other side of the impeller 40. These arrangements also enable the first chamber 51 and the second chamber 52 to communicate with each other via the communication hole 48.

More specifically, according to the modification shown in FIGS. 14(A) to 14(C), the communication hole 48 may be positioned adjacent to the outer edges of the opposing pair of the grooves 42. As shown in FIG. 14(C), a first shallow circumferential groove 51*f* may be formed in the upper wall of the impeller receiving space in a position adjacent to the outer edges of the grooves 42 and may extend in continuity with the first pump channel 51. A second shallow circumferential groove 52*f* may be formed in the lower wall of the impeller receiving space in a position adjacent to the outer edges of the grooves 42 and may extend in continuity with the second pump channel 52.

The modification shown in FIGS. 15(A) to 15(C) is different from the modification shown in FIGS. 14(A) to 14(C) in that the communication hole 48 may be positioned adjacent to the inner edges of the axially opposing pair of the grooves 42. In addition, each of the circumferential grooves 51*f* and 52*f* may be positioned adjacent to the inner edges of the opposing pair of the grooves 42 as shown in FIG. 15(C).

The modification shown in FIGS. 16(A) to 16(C) is different from the modification shown in FIGS. 14(A) to 14(C) in that the shallow circumferential grooves 51*f* and 52*f* are not incorporated. Instead, the width in the radial direction of each of the first pump channel 51 and the second pump channel 52 may be extended over the communication hole 48 as shown in FIG. 16(C).

The modification shown in FIGS. 17(A) to 17(C) is different from the modification shown in FIGS. 15(A) to 15(C) in that the shallow circumferential grooves 51*f* and 52*f* are not incorporated. Instead, the width in the radial direction of each of the first pump channel 51 and the second pump channel 52 may be extended over the communication hole 48 as shown in FIG. 17(C).

Although the communication hole 48 is associated with only one pair of the opposing grooves 42 in the modifications shown in FIGS. 14(A) to 14(C) to FIGS. 17(A) to 17(C), two or more communication holes 48 may be formed in association with plural pairs of the opposing grooves 42.

Furthermore, although the second representative impeller pump and its modifications are designed to have one communication hole 48 formed in association with one or each pair of the opposing grooves 42, two or more communication holes 48 may be formed in association with one or each pair of the opposing grooves 42.

A third representative impeller pump will now be described with reference to FIGS. 18(A), 18(B) and 18(C) to FIGS. 20(A) and 20(B).

The third representative impeller pump may be configured as a two-stage type pump and may be different from the first and second representative impeller pumps in the construction of a pump casing. Otherwise, the construction of the third representative impeller pump is substantially the same as the first representative impeller pump. Therefore, in FIGS. 18(A), 18(B) and 18(C) to FIGS. 20(A) and 20(B), like members are given the same reference numerals as the first representative impeller and an explanation of these members will not be necessary.

Referring to FIG. 18(A), the third representative impeller pump may have two impellers 60 that are disposed within the pump casing 6. These two impellers 60 may have the same construction with each other. The shaft 5*a* of the armature 5 may engage the impellers 60 in the rotational direction in the same manner as the impeller 10 of the first representative impeller pump (see FIG. 4), so that the impellers 60 can rotate about the same axis.

Because the impellers 60 have the same construction, the construction of only one of the impellers 60 will be described.

A group of grooves 62 may be formed in the peripheral portion on each of upper and lower surfaces of the impeller 60. The grooves 62 on each side of the impeller 60 may be arranged at regular intervals in the circumferential direction. In other words, two adjoining grooves 62 may be spaced from each other by a predetermined pitch. However, as shown in FIG. 18(B), the group of grooves 62 on one side of the impeller 60 may be offset by a distance of quarter the pitch of the grooves 62 relative to the group of grooves 62 on the other side.

The configuration of the grooves 62 may be the same as the grooves 12 of the first representative impeller pump. Therefore, an explanation of the grooves 62 will not be necessary.

Each pair of the grooves 62 that oppose to each other in the axial direction may communicate with each other via a communication hole 68. As described in connection with the second representative impeller pump and its modifications, two or more communication holes 68 may be provided in association with corresponding pairs of the opposing grooves 62.

A first pump channel or a first chamber 71 and a second pump channel or a second chamber 72 may be defined in the pump casing 6 and may be disposed on the upper side and the lower side, respectively, as viewed in FIGS. 18(A) and 18(B) of one of the impellers 60 that is positioned on the upper side as viewed in FIGS. 18(A) and 18(B). The impeller 60 disposed on the upper side will be hereinafter also called "upper impeller 60" or "first-stage impeller 60" and the impeller 60 disposed on the lower side will be hereinafter also called "lower impeller 60" or "second-stage impeller 60."

A discharge port 71*p* of the first chamber 71 and an outlet port 72*p* of the second chamber 72 for the first-stage impeller 60 may be positioned at the same position as viewed in plan view, i.e. as viewed in the axial direction of the impellers 60.

Therefore, as shown in FIG. 18(C), a phase PS 1 of the pulsation of the fluid discharged from the second chamber 72 may be delayed by about quarter of the cyclic period of the pulsation relative to a phase PS2 of the pulsation of the fluid discharged from the first chamber 71.

A first pump channel or a first chamber 73 and a second pump channel or a second chamber 74 may be defined in the pump casing 6 and may be disposed on the upper side and the lower side, respectively, as viewed in FIGS. 18(A) and 18(B) of the second-stage impeller 60.

An outlet port 73*p* of the first chamber 73 and an outlet port 74*p* of the second chamber 74 for the second-stage impeller 60 may be positioned at the same position as viewed in plan view, i.e. as viewed in the axial direction of the impellers 60.

In addition, the position of the outlet port 73*p* of the fist pump chamber 73 (and the outlet port 74*p* of the second chamber 74) for the second-stage impeller 60 may be offset in the circumferential direction from the position of the outlet port 71*p* of the fist pump chamber 71 (and the outlet port 72*p* of the second chamber 72) for the first-stage impeller 60 by a distance of half the pitch of the grooves 62

Therefore, a phase PS3 of the pulsation of the fuel discharged from the fist pump chamber 73 of the second stage may advance by half the cyclic period of the pulsation relative to the phase PS1 of the pulsation of the fuel discharge from the first chamber 71 of the first stage. In addition, a phase PS4 of the pulsation of the fuel discharged from the second chamber 74 of the second stage may advance by quarter the cyclic period relative to the phase PS3 of the pulsation of the fuel discharged from the fist pump chamber 73 of the second stage.

As a result, when the phase PS1 of the pulsation of the fuel discharged from the first chamber 71 of the first stage is taken as a reference, the phase PS2 of the pulsation of the fuel discharged from the second chamber 72 of the first stage, the phase PS3 of the pulsation of the fuel discharged from the first chamber 73 of the second stage, and the phase PS4 of the pulsation of the fuel discharged from the second chamber 74 may in turn delayed by quarter the cyclic period.

In other words, the phase PS3 may be delayed by half the cyclic period relative to the phase PS1, and the phase PS4 may be delayed by half the cyclic period relative to the phase PS2.

The fuel discharged from each of the first chambers 71 and 73 and the fuel discharged from each of the second chambers 72 and 74 may flow into and converge at a discharge channel 75 (see FIG. 18(A)). As a result, the pulsations of the fuel discharged from the first chambers 71 and 73 and the second chambers 72 and 74 may be canceled each other.

According to the third representative impeller pump, the group of grooves 62 on one side of the impeller 60 is offset relative to the group of grooves 62 on the other side of the impeller 60 by a distance of quarter the pitch of the grooves 62. The third representative impeller pump may be modified as shown in FIG. 19(A), in which the grooves 62 on one side of the impeller 60 are positioned at the same position as the grooves 62 on the other side of the impeller 60. In this modification, the outlet ports 71*p*, 72*p*, 73*p* and 74*p* of the respective pump chambers 71, 72, 73 and 74 may be offset by a distance of quarter the pitch of the grooves 62.

More specifically, the outlet port 72*p* of the second chamber 72 for the first-stage impeller 60 may be offset toward the upstream side relative to the outlet port 71*p* of the first chamber 71 by a distance of quarter the pitch of the grooves 62. The outlet port 73*p* of the first pump channel 73 for the second-stage impeller 60 may be offset toward the upstream side relative to the outlet port 72*p* of the second chamber 72 for the first-stage impeller 60 by a distance of quarter the pitch of the grooves 62. The outlet port 74*p* of the second chamber 74 for the second-stage impeller 60 may be offset relative to the outlet port 73*p* of the first chamber 73 for the second-stage impeller 60 by a distance of quarter the pitch of the grooves 62.

Also with this arrangement, when the phase PS1 of the pulsation of the fuel discharged from the first chamber 71 of the first stage is taken as a reference, the phase PS2 of the pulsation of the fuel discharged from the second chamber 72 of the first stage, the phase PS3 of the pulsation of the fuel discharged from the first chamber 73 of the second stage, and the phase P4 of the pulsation of the fuel discharged from the second chamber 74 may be in turn delayed by quarter the cyclic period. Therefore, the pulsation of the fuel discharged from the first chambers 71 and 73 and the second chambers 72 and 74 may be canceled each other when the flows of the fuel are converged at the discharge channel 75.

Another modification of the third representative embodiment is shown in FIG. 19(B), in which the group of grooves 62 on one side of the impeller 60 is offset in the rotational direction relative to the grooves 62 on the other side of the impeller 60 by a distance of half the pitch of the grooves 62. One or each pair of the axially opposing grooves 62 may communicate with each other via the communication hole 68.

The outlet port 71*p* of the first chamber 71 and the outlet port 72*p* of the second chamber 72 for the first-stage impeller 60 may be positioned at the same position in the direction as viewed in plan view or in the axial direction. Therefore, the phase PS1 of the pulsation of the fuel discharge from the first chamber 71 may be advanced by half the cyclic period relative to the phase PS2 of the pulsation of the fuel discharged from the second chamber 72.

The outlet port 73*p* of the first chamber 73 and the outlet port 74*p* of the second chamber 74 for the second-stage impeller 60 may be positioned at the same position in the direction as viewed in plan view or in the axial direction. In addition, the outlet port 73*p* of the first chamber 73 for the second-stage impeller 60 may be disposed on the downstream side relative to the outlet port 71*p* of the first chamber 71 for the first-stage impeller 60 by a distance of quarter the pitch of the grooves 62.

Therefore, the phase PS3 of the pulsation of the fuel discharged from the fist pump chamber 73 of the second stage may be delayed relative to the phase Ps1 of the pulsation of the fuel discharged from the first chamber 71 by quarter the cyclic period. In addition, the phase PS4 of the pulsation of the fuel discharged from the second chamber 74 may be delayed relative to the phase PS3 of the pulsation of the fuel discharged from the first chamber 73 of the second stage by half the cyclic period.

As a result, when the phase PS1 of the pulsation of the fuel discharged from the first chamber 71 of the first stage is taken as a reference, the phase PS3 of the pulsation of the fuel discharged from the first chamber 73 of the second stage, the phase PS2 of the pulsation of the fuel discharged from the second chamber 72 of the first stage, and the phase PS4 of the pulsation of the fuel discharged from the second chamber 74 may be in turn delayed by quarter the cyclic period. Therefore, the pulsations of the fuel discharged from the first chambers 71 and 73 and the second chambers 72 and 74 may be canceled each other when the flows of the fuel converge at the discharge channel 75.

A further modification of the third representative impeller pump is shown in FIGS. 20(A) and 20(B). In this modification, the upper impeller 60 may have the configuration as shown in FIG. 19(B), in which the group of grooves 62 on one side of the impeller 60 may be offset relative to the group of grooves 62 on the other side of the impeller 60 by a distance of half the pitch of the grooves 62.

In addition, an impeller 80 for the second stage may have a configuration that is different from the configuration of the upper impeller 60. Further, the first chamber 71 and the second chamber 72 for the upper impeller 60 may be connected in series with a first chamber 81 and a second chamber 82 that are defined on the upper side and lower side of the lower impeller 80, respectively.

Similar to the impeller 60, a group of grooves 84 may be formed in the peripheral portion of each of upper and lower surfaces of the impeller 80. The grooves 84 on each side of the impeller 80 may be arranged at regular intervals in the circumferential direction. The pitch between two adjacent grooves 84 may be the same as the pitch between two adjacent grooves 62.

However, the group of grooves 84 on one side of the impeller 80 and the group of grooves 84 on the other side of the impeller 80 may be disposed at the same position with each other as viewed in plan view, or as viewed in the axial direction. In addition, each pair of the axially opposing grooves 84 may communicate with each other via a communication channel 84*t*.

The fuel may enter the second chamber 82 via an inlet port 82*e*. Then, the fuel may be pressurized within the second chamber 82 due to the operation of the grooves 84 formed on the lower side of the impeller 80. At the same time, the fuel may flow through the communication holes 84*t* and may enter the first chamber 81. The fuel that has entered the first pump channel 81 may be pressurized by the operation of the grooves 84 formed on the upper side of the impeller 80. The fuel pressurized within the first chamber 81 may then be discharged from the first chamber 81 via an outlet port 81*p*. On the other hand, the fuel pressurized within the second chamber 82 may be discharged from the second chamber 82 via the communication holes 84*t* and the outlet port 81*p*.

The fuel discharged from the outlet port 81*p* may flow through a lower branch channel 84 and an upper branch channel 85 and may then enter the first chamber 71 and the second chamber 72 for the upper impeller 60, respectively, via the first inlet port 71*e* and the second inlet port 72*e*.

The fuel that has entered the first chamber 71 and the second chamber 72 may be further pressurized by the kinetic energy applied by the grooves 62 of the impeller 60 and then may flow from the first chamber 71 and the second chamber 72 toward the outlet ports 71*p* and 72*p*, respectively (see FIG. 19(B)).

As described above, the group of grooves 62 on the upper side of the impeller 60 may be offset in the circumferential direction relative to the group of the grooves 62 on the lower side of the impeller 60 by a distance of half the pitch of the grooves 62. Therefore, the phase of pulsation of the fuel discharged from the first chamber 71 via the first outlet port 21*p* and the phase of pulsation of the fuel discharged from the second chamber 72 via the second outlet port 72*p* may be shifted about half the cyclic period of the pulsation.

Therefore, when the flow of the fuel discharged from the first chamber 71 and the flow of the fuel discharged from the second chamber 72 are converged at the discharge channel 75, the pulsations of the fuel may be canceled.

Although the third representative embodiments and their modifications have been described in connection with impeller pumps that have two impellers, the third representative embodiment may further be modified to have three or more impellers and respective pairs of first and second chambers.

In addition, according to the third representative embodiment, the phase PS1 of the pulsation of the fuel discharged from the first chamber 71 and the phase PS2 of the pulsation of the fuel of the second chamber 72 of the first stage are shifted from each other by quarter the cyclic period, and the phase PS3 of the pulsation of the fuel discharged from the first chamber 73 and the phase PS4 of the pulsation of the fuel discharged from the second chamber 74 of the second stage are shifted from each other by quarter the cyclic period. However, the shift between the phases PS1 and PS2 and the shift between the phases PS3 and PS4 may not be limited to be quarter the cyclic period, as long as the shift between the phases PS1 and PS3 and the shift between the phases PS2 and PS4 can be determined to be half the cyclic period.

Further, although the above representative embodiments and their modifications have been described in connection with impeller pumps that are designed as fuel pumps for delivering the fuel to vehicle engines, the present invention also may be applied to any kind of impeller pumps for pumping fluid other than the fuel, e.g., hydraulic fluid and water.

What is claimed:

1. An impeller pump comprising:

a pump casing defining at least one pump chamber, the pump chamber including a first chamber and a second chamber, wherein an impeller is disposed within the pump chamber and is rotatable about a rotational axis, a first groove group and a second groove group each comprising a plurality of grooves, the first groove group and the second groove group being defined in opposite surfaces of the impeller in a direction of the rotational axis of the impeller, and the first groove group and the second groove group opposing to the first chamber and the second chamber, respectively, so that a fluid is drawn into and discharged from each of the first and second chambers as the impeller rotates, wherein the fluid is discharged from the first chamber and the second chamber with pulsations in a predetermined cyclic period, a converging channel coupled to the first and second chambers of the at least one pump chamber, wherein phases of pulsations of the fluid discharged from the first and second chambers of the at least one pump chamber are adjusted, so that the pulsations are substantially canceled when the pulsations are superposed with each other.

2. An impeller pump as in claim 1 further including means for communicating between first and second chambers, so that pressures within the first and second chambers are balanced.

3. An impeller pump as in claim 2, wherein the communication means comprises at least one communication hole defined within the impeller.

4. An impeller pump as in claim 3, wherein a plurality of communications holes are provided and each of the communication holes extends between the corresponding pair of axially opposing grooves of the first and second groove groups of the impeller.

5. An impeller pump as in claim 4, wherein the number of the pairs of axially opposing grooves that communicate with the communication holes are larger than number of the pairs of axially opposing grooves that do not communicate with the communication holes.

6. An impeller pump as in claim 4, wherein the communication hole communicates with the pair of axially opposing grooves at first edges of openings of the grooves, the first edges are positioned on the inside of grooves in a radial direction of the impeller.

7. An impeller pump as in claim 4, wherein the communication hole communicates with the pair of axially opposing grooves at second edges of openings of the grooves, the second edges are positioned on the outside of the grooves in a radial direction of the impeller.

8. An impeller pump as in claim 4, wherein the communication hole is offset from the pair of axially opposing grooves and communicate with the opposing grooves via additional grooves defined in opposite surfaces of the impeller.

9. An impeller pump as in claim 3, wherein the communication hole extends not to communicate with the grooves of the first and second groove group.

10. An impeller pump as in claim 9, wherein communication hole is disposed adjacent to a pair of axially opposing grooves of the first and second grooves groups.

11. An impeller pump as in claim 10, wherein the communication hole is disposed adjacent to first edges of openings of the pair of axially opposing grooves, and the first edges are positioned on the inside of the grooves in a radial direction of the impeller.

12. An impeller pump as in claim 11, wherein the first and second chambers are arranged and constructed to extend over the communication hole.

13. An impeller pump as in claim 10, wherein the communication hole is disposed adjacent to second edges of openings of the pair of axially opposing grooves, and the second edges are positioned on the outside of the grooves in a radial direction of the impeller.

14. An impeller pump as in claim 13, wherein the first and second chambers are arranged and constructed to extend over the communication hole.

15. An impeller pump as in claim 3, wherein a ratio of a cross sectional area of the communication hole to an opening of each of the grooves of the impeller is set to be within a range of about 1% to about 40%.

16. An impeller pump as in claim 15, wherein the ratio is set to be within a range of about 3% to about 18%.

17. An impeller pump as in claim 1, wherein the grooves of each of the first and second groove groups are spaced from each other by a predetermined pitch in the circumferential direction.

18. An impeller pump as in claim 17, wherein each of the first and second chambers includes an inlet port and an outlet port, and the relative positions in the circumferential direction of the outlet ports of the first and second chambers and the relative positions in the circumferential direction of the first groove group and the second groove are determined so as to adjust the phases of the pulsations.

19. An impeller pump as in claim 18, wherein the outlet ports of the first and second chambers are disposed at the same position with each other in the circumferential direction, and the first groove group and the second groove group are offset from each other by a distance equal to the pitch of the grooves divided by the number of the groove groups, so that the phases of the pulsations of the fluid discharged from the first and second chambers are shifted from each other by a cyclic period of the pulsations divided by the number of the groove groups.

20. An impeller pump as in claim 18, wherein the first groove group and the second groove group are positioned at the same position on the circumferential direction, and the positions in the circumferential direction of the outlet ports of the first and second chambers of the at least one pump chamber are determined to be offset from each other by a distance that corresponds to the pitch of the grooves divided by the number of the grooves groups, so that phases of the pulsations of the fluid discharged from the first and second chambers are shifted from each other by the cyclic period of the pulsations divided by the number of the groove groups.

21. An impeller pump as in claim 1, wherein the fluid is a fuel that is supplied to an automobile engine.

22. An impeller pump comprising:

a pump casing defining a pump chamber, the pump chamber including a first chamber and a second chamber, an impeller disposed within the pump chamber and rotatable about a rotational axis, a first groove group and a second groove group each comprising a plurality of grooves, the first groove group and the second groove group being defined in opposite surfaces of the impeller in a direction of the rotational axis of the impeller, and the first groove group and the second groove group opposing to the first chamber and the second chamber, respectively, so that a fluid is drawn into and discharged from each of the first and second chambers as the impeller rotates, wherein the fluid is discharged from the first chamber and the second chamber with pulsations in a predetermined cyclic period, and a converging channel coupled to the first and second chambers, wherein:

the grooves of each of the first and second groove groups are spaced from each other by a predetermined pitch in the circumferential direction, each of the first and second chambers includes an inlet port and an outlet port, the outlet ports of the first and second chambers are disposed at the same position with each other in the circumferential direction, and the first groove group and the second groove group are offset from each other by a distance half the pitch of the grooves, so that the phases of the pulsations of the fluid discharged from the first and second chambers are shifted from each other by half a cyclic period of the pulsations.

23. An impeller pump as in claim 22, further including an additional pump section that is connected in series on an upstream side of the pump chamber.

24. An impeller pump comprising:

a pump casing defining a pump chamber, the pump chamber including a first chamber and a second chamber, an impeller disposed within the pump chamber and rotatable about a rotational axis, a first groove group and a second groove group each comprising a plurality of grooves, the first groove group and a second groove group being defined in opposite surface of the impeller in a direction of the rotational axis of the impeller, and the first groove group and the second groove group opposing to the first chamber and the second chamber, respectively, so that a fluid is drawn into and discharged from each of the first and second chambers as the impeller rotates, wherein the fluid is discharged from the first chamber and the second chamber with pulsations in a predetermined cyclic period, and a converging channel coupled to the first and second chambers, wherein:

the grooves of each of the first and second groove groups are spaced from each other by a predetermined pitch in the circumferential direction, each of the first and second chambers includes an inlet port and an outlet port, and the first groove group and the second groove group are positioned at the same position on the circumferential direction, and the positions in the circumferential direction of the outlet ports of the first and second chambers are determined to be offset from each other by a distance that corresponds to half the pitch of the grooves, so that phases of the pulsations of the fluid discharged from the first and second chambers are shifted from each other by half the cyclic period of the pulsations.

25. An impeller pump as in claim 24, further including an additional pump section that is connected in series on an upstream side of the pump chamber.

26. An impeller pump comprising:

a pump casing defining two pump chambers each including a first chamber and a second chamber;

impellers disposed within respective pump chambers and rotatable about a rotational axis, a first groove group and a second groove group each comprising a plurality of grooves, the first groove group and the second group being defined in opposite surfaces of the impeller in a direction of the rotational axis of each impeller, and the first groove group and the second groove group opposing to the first chamber and the second chamber, respectively, so that a fluid is drawn into and discharged from each of the first and second chambers as the impellers rotates, wherein the fluid is discharged from the first chamber and the second of each pump chamber with pulsations in a predetermined cyclic period, a converging channel coupled to the first discharged from the first and second chambers of the pump chambers are adjusted, so that the pulsations are substantially canceled when the pulsations are superposed with each other, wherein:

the grooves of each of the first and second groove groups are spaced from each other by a predetermined pitch in the circumferential direction, each of the first and second chambers includes an inlet port and an outlet port, and the relative positions in the circumferential direction of the outlet ports of the first and second chambers and the relative positions in the circumferential direction of the first groove group and the second groove group are determined, so that the phases of pulsations of the fluid discharged from the first and second chambers of the pump chambers are shifted from each other by quarter the cyclic period of the pulsations.

27. An impeller pump as in claim 26, wherein:

the first groove group is offset relative to the second groove group by a distance of quarter the pitch of the grooves in the circumferential direction, the outlet ports of the first and second chambers in each pair of the first and second chambers are disposed at the same position in the circumferential direction, and the outlet ports of one of the pairs of the first and second chambers are offset relative to the outlet ports of the other pair of the first and second chambers by a distance corresponding to half the pitch of the grooves.

28. An impeller pump as in claim 26, wherein:

the first groove group and second groove group are disposed at the same position in the circumferential direction, and the outlet ports of the first and second chambers in each pair of the first and second chambers are offset relative to each other by a distance corresponding to quarter the pitch of the grooves.

29. An impeller pump as in claim 26, wherein:

the first groove group is offset relative to the second groove group by a distance corresponding to half the pitch of the grooves, the outlet ports of the first and second chambers in each pair of the first and second chambers are disposed at the same position in the circumferential direction, and the outlet ports of one of the pairs of the first and second chambers are offset from the outlet ports of the other pair of the first and second chambers by a distance corresponding to quarter the pitch of the grooves.

30. An impeller pump comprising:

a pump casing, an impeller disposed within the pump casing and arranged and constructed to be rotatably driven about a rotational axis, a first groove group and a second groove group disposed on opposite sides of the impeller, each of the first and second groove groups including a plurality of grooves arranged in the circumferential direction, so that pulsations having substantially the same cyclic period are produced in a fluid by the first groove group and the second groove group, a first chamber defined within the pump casing and having a first inlet port and a first outlet port, wherein the first chamber opposes to the first groove group of the impeller;

a second chamber defined within the pump casing and having a second inlet port and a second outlet port, wherein the second chamber opposes to the second groove group of the impeller;

a communication hole defined in the impeller and extending between the first chamber and the second chamber; and a converging channel defined within the pump casing and communicating with the first outlet port and the second outlet port, so that the fluid discharged from the first outlet port and the fluid discharged from the second outlet port converge at the converging channel, wherein:

the first groove group and the second groove group are offset from each other in the circumferential direction and/or the first outlet port of the first chamber and the second outlet port of the second chamber are offset from each other in the circumferential direction, so that a phase of pulsation of the fluid discharged from the first chamber is shifted relative to a phase of pulsation of the fluid discharged from the second chamber by half the cyclic period of the pulsations.

31. An impeller pump as in claim 30, wherein the communication hole is formed to extend between one of the grooves of the first groove group and one of the grooves of the second groove group that opposes to each other in the axial direction.

32. An impeller pump as in claim 30, wherein the communication hole is defined in a position not to interfere with the grooves.

33. An impeller pump as in claim 30, wherein a ratio of a cross sectional area of the communication hole to an open area of the grooves is set to be within a range of about 1% to about 70%.

34. A pump comprising:

a pump casing, a plurality of impellers disposed within the pump casing and arranged and constructed to be rotatably driven about a rotational axis, a first groove group and a second groove group disposed on opposite sides of each of the impellers, each of the first and second groove groups including a plurality of grooves arranged in the circumferential direction, so that pulsations having substantially the same cyclic period are produced in a fluid by the first groove group and the second groove group, a plurality of pump chambers each comprising a fist pump chamber and a second chamber that oppose to the first groove group and the second groove group, respectively, of the corresponding impeller, the first chamber being defined within the pump casing and having a first inlet port and a first outlet port, the second chamber being defined within the pump casing and having a second inlet port and a second outlet port, a communication hole defined within each of the impeller and communicating between the first chamber and the second chamber of the corresponding pump chamber; and a converging channel defined within the pump casing and communicating with the first outlet port and the second outlet port of each of the pump chambers, so that a fluid discharged from the pump chambers converge at the converging channel, wherein:

the first groove group and the second groove group are offset from each other in the circumferential direction and/or the first outlet port of the first chamber and the second outlet port of the second chamber are offset from each other in the circumferential direction, so that a phase of pulsation of the fluid discharged from the first chamber is shifted relative to a phase of pulsation of the fluid discharged from the second chamber by a predetermined period, and the first outlet ports of the first chambers of two adjacent pump chambers are offset each other, so that phases of pulsations of the fluid discharged from the first chambers of two adjacent pump chambers are shifted by substantially half the cyclic period of the pulsations.

35. An impeller pump as in claim 34, wherein the communication hole is formed to extend between one of the grooves of the first groove group and one of the grooves of the second groove group that opposes to each other in the axial direction.

36. An impeller pump as in claim 34, wherein the communication hole is defined in a position not to interfere with the grooves.

37. An impeller pump as in claim 34, wherein a ratio of a cross sectional area of the communication hole to an open area of the grooves is set to be within a range of about 1% to about 70%.

* * * * *